United States Patent [19]

Tyler et al.

[11] Patent Number: 4,674,047

[45] Date of Patent: Jun. 16, 1987

[54] INTEGRATED DETONATOR DELAY CIRCUITS AND FIRING CONSOLE

[75] Inventors: Lawson J. Tyler; Paul N. Worsey, both of Rolla, Mo.

[73] Assignee: The Curators of the University of Missouri, Columbia, Mo.

[21] Appl. No.: 575,324

[22] Filed: Jan. 31, 1984

[51] Int. Cl.[4] ..... F42C 11/06; F42C 17/00; G06K 5/00; G06F 15/58

[52] U.S. Cl. ..... 364/423; 102/200; 102/206; 102/218; 235/400

[58] Field of Search ..... 364/423; 235/400; 102/200, 206, 215, 217, 218, 219, 220; 340/825.31

[56] References Cited

U.S. PATENT DOCUMENTS

| | | | |
|---|---|---|---|
| 3,463,911 | 8/1969 | Dupraz et al. | 364/728 |
| 3,500,746 | 3/1970 | Ambrosini | 102/213 |
| 3,646,371 | 2/1972 | Flad | 307/293 |
| 3,851,589 | 12/1974 | Meyer | 102/215 |
| 3,967,554 | 7/1976 | Troyer, Jr. | 102/215 X |
| 3,979,580 | 9/1976 | Crilly et al. | 102/215 |
| 3,984,637 | 10/1976 | Caudill et al. | 340/825.31 X |
| 4,065,709 | 12/1977 | Sliwa et al. | 102/215 X |
| 4,114,139 | 9/1978 | Boyd et al. | 340/825.31 |
| 4,116,133 | 9/1978 | Beuchat | 102/215 |
| 4,136,617 | 1/1979 | Fowler | 102/220 |
| 4,137,850 | 2/1979 | Donner | 102/215 |
| 4,183,085 | 1/1980 | Roberts et al. | 364/200 |
| 4,254,475 | 3/1981 | Cooney et al. | 102/215 X |
| 4,273,051 | 6/1981 | Stratton | 102/202.2 |
| 4,310,720 | 1/1982 | Check, Jr. | 364/900 |
| 4,324,182 | 4/1982 | Kirby et al. | 102/215 X |
| 4,387,649 | 6/1983 | Weidner et al. | 102/206 X |
| 4,419,933 | 12/1983 | Kirby et al. | 102/206 |
| 4,424,745 | 1/1984 | Magorian et al. | 102/215 |
| 4,430,728 | 2/1984 | Beitel et al. | 364/900 |
| 4,445,435 | 5/1984 | Oswald | 102/220 X |
| 4,450,535 | 5/1984 | De Pommery et al. | 364/900 |

OTHER PUBLICATIONS

Lowe et al. "The Application of Film Bridge Chip Technology to Electro-Explosive Devices".

Mead et al., "Introduction to VLSI Systems", pp. 78–88, E²PROM Family Applications Handbook, pp. 4–97 through 4–128.

*Primary Examiner*—Felix D. Gruber

*Attorney, Agent, or Firm*—Senniger, Powers, Leavitt and Roedel

[57] ABSTRACT

A detonation system for use with supply of electrical energy has user operable firing console for selectably transmitting unit identification information, firing delay time information and selections from a command set including Output, Delay, Fire (Time), Abort, Power Up (Arm), Input, and Store. The console displays responses or information digested from responses by electrical delay detonators to the commands. The detonators have explosive, a capacitor for storing energy from the supply to set off the explosive, circuitry for charging the capacitor from the supply and transferring the energy from the capacitor to the explosive in response to first and second signals generated in response to the commands. Each detonator can be programmed with a unique identification number and delay time. The time base in each detonator can be compensated so that errors in the time base are obviated so as to achieve the correct delay. Security code circuitry and software are described so that each detonator can only be set off by authorized users.

46 Claims, 27 Drawing Figures

ASCII
BCD
FORMAT

FACTORY CODE
UNIT ID CODE
COMMAND

INTEGRATED DETONATOR DELAY CIRCUITS AND FIRING CONSOLE

BACKGROUND OF THE INVENTION

The present invention relates to electronic blasting delay detonator units. More specifically, the present invention relates to such blasting delay detonator units utilizing attached or self-contained integrated timing circuits.

Presently known delay detonators have a built-in chemical delay located between the fuse head and primary charge. The length of delay is affected by the use of differing chemical mixes and lengths of the delay unit. It is believed that existing delay detonators are frequently inaccurate, their inaccuracy stemming from the chemical delay element, especially in long series delay detonators. The inaccuracies are such that detonators in a delay series can explode out of sequence. Also, known electric delay detonators have a significant risk of accidental detonation by static electricity, stray currents, induction from overhead power cables, and radio waves. Known delay detonators are believed to be less than fully secure from use by unauthorized personnel.

SUMMARY OF THE INVENTION

Among the several objects of the present invention are to replace chemical delay by a compact electronic package exhibiting substantially greater flexibility of operation for an electrical delay detonator; to significantly increase delay detonator accuracy; to increase delay detonator flexibility so that one integrated electronic unit is programmable for any delay time; to increase delay detonator safety over presently available delay detonators; to provide an electronic delay detonator capable of two-way communication with a detonation controller in order to provide status information about the integrated component within the blasting delay detonator unit; to provide an electronic blasting delay detonator unit having a fail-safe mode of operation incorporated into the device to prevent premature ignition of the detonator; to provide an electronic blasting delay detonator unit which recognizes a unique detonation code to start its delay timer sequence; to provide an electronic blasting delay detonator unit having a power storage capability within the device to allow independent operation once the detonation code has been recognized; to provide an electronic blasting delay detonator unit having power up and power down modes of operation which are usable in the event it is necessary to abort the firing of a detonator network; to provide an electronic blasting delay detonator unit having the ability to modify the sequence of operation from a detonator console in field application; to provide a precision electronic blasting delay detonator unit utilizing attached or self-contained integrating timing circuits which can be controlled through a single pair of wires and so that two or more such detonator units are connectable in a parallel wired electrical network; to provide an electronic blasting delay detonator unit which is able to be charged or fired by either electrical means or optical means; to provide an electronic blasting delay detonator unit which is able to electronically respond to an integrated initiation device immediately prior to blasting giving status, program delay time, and designated number; to provide an electronic blasting delay detonator unit having a factory programmed security code unique to the operator which excludes unauthorized use; to provide an electronic blasting delay detonator unit which can be rendered harmless by issuing an abort command from a firing console; to provide an electronic blasting delay detonator unit having a two-part security code in which the first part of the code is unique to the user and which can be kept secret with the manufacturer so that the user need not know the code and the second part being a fire control command which initiates timing circuits and subsequently capacitive discharge and firing of the individual detonators; to provide an electronic blasting console system compatible with the foregoing electronic blasting delay detonator units having a fire control program requiring a single user security code for usage; to provide an electronic blasting delay detonator unit having three leg wires, two long ones for power and firing purposes and the third solely for factory programming which can be clipped and sealed.

In one of its aspects the invention involves electronic apparatus for use with a capacitor, an explosive, a supply of electrical energy, and a firing console for transmitting information including commands and a firing delay time. The apparatus includes (A) means for charging the capacitor from the supply in response to occurrence of a first signal and for transferring stored electrical energy to the explosive thereby to fire the explosive in response to occurrence of a second signal; and (B) means for storing an electrical representation of the firing delay time supplied from the firing console, for responding to a first command from the firing console by transmitting the firing delay time representation stored in the apparatus to the firing console, for supplying the first signal in response to a second command from the firing console, and for supplying the second signal as soon as a time interval, commencing on a third command from the firing console, has elapsed, which time interval is substantially equal to the firing delay time stored in the apparatus.

Another aspect of the invention involves an electronic delay detonator for use with a supply of electrical energy and a firing console for providing commands. The electronic delay detonator includes a capacitor; an explosive; and electronic apparatus including means for charging the capacitor from the supply in response to occurrence of a first signal and for transferring stored electrical energy to the explosive thereby to fire the explosive in response to occurrence of a second signal; and means for storing an electrical representation of the firing delay time supplied from the firing console, for responding to a first command from the firing console by transmitting the firing delay time representation stored in the apparatus to the firing console, for supplying the first signal in response to a second command from the firing console, and for supplying the second signal as soon as a time interval, commencing on a third command from the firing console, has elapsed, which time interval is substantially equal to the firing delay time stored in the apparatus.

In still another aspect the invention involves a detonation system for use with a supply of electrical energy. The system includes user operable firing console means for selectably transmitting unit identification information, firing delay time information and selections from a command set including at least first, second and third commands, and for displaying responses to at least one of the commands; and a plurality of units of apparatus each comprising in physical association explosive means; means for temporarily storing electrical energy from the supply in response to occurrence of a first signal and for transferring stored electrical energy to the explosive thereby to fire the explosive in response to occurrence of a second signal; and means for storing a code identifying the apparatus as a unit, for storing an electrical representation of the firing delay time information supplied from the firing console, for responding to the first command from the firing console by transmitting the stored firing delay time representation to the firing console only when the firing console has previously sent unit identification information matching the stored code, for supplying the first signal in response to the second command from the firing console, and for supplying the second signal as soon as a time interval, commencing on the third command from the firing console, has elapsed, which time interval is substantially equal to the firing delay time stored in the apparatus.

In still another aspect the invention involves an electronic circuit for use in an electrical delay detonation system including a firing console for sending information transmissions and a detonator with means for firing the detonator in response to occurrence of a signal to fire. The electronic circuit includes means for decoding the transmissions from the firing console into a security portion and into a command portion; and means for generating the signal to fire in response to the command portion only if the security portion matches a predetermnined code.

In still another aspect the invention involves a firing console for operation in combination with a plurality of delay detonators. The firing console includes means for storing a code including a prestored normally user-inaccessible code portion; and means for transmitting a selectable command together with the code to the delay detonators, the code as transmitted including the user-inaccessible code portion and a user-selectable code portion indicative of an individual one of the electrical delay detonators for which the selectable command is intended.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
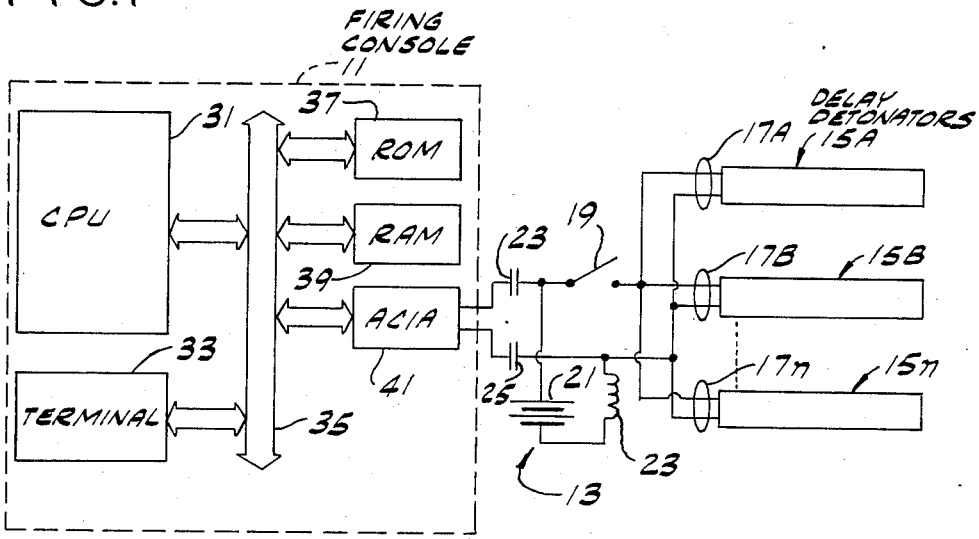
FIG. 1 is a block diagram of a firing console, dc power supply and integrated delay detonators of the present invention.

Conventional chemical delay elements in delay detonators are inaccurate and can seriously affect blasting efficiency. The replacement of the chemical delay element by a self-contained micro-electronic delay element as described herein within delay detonators is intended to dramatically improve accuracy. Increasing sophistication in production of micro-electronic circuits has, and still is causing a rapid drop in the price of microcircuitry such that a self-contained integrated electronic delay detonator is now not only technically feasible, but also economic. In addition to highly accurate timing circuits, the micro-chip design described herein incorporates:

1. Safety elements, including a unique fire control command which eliminates the majority of types of accidental electrical initiation.
2. On-line programmability such that a single detonator may be programmed for any delay period.
3. A factory programmed security code unique to the operator which will provide a high degree of security and exclude unauthorized use.
4. Interactive report back facilities for complete status and circuit check before firing.

Errors in delay timing of detonators can detrimentally influence blasting performance and vibration amplitudes. In order to obtain maximum efficiency from explosives within a blast pattern, each hole should firstly go off in the correct sequence. Secondly, each hole should have enough time separation from its preceding and succeeding delay periods not to interfere with or be interfered with by either of the latter.

During the period of the last two decades, gigantic advances have been made in electronics within the field of microcircuitry. It is now common for over 1,000,000 transistors to be "cast" in silicon on a single microchip of 0.25 cm by 0.25 cm or less with anticipated doubling in density every year.

In the present invention, prior delay blasting caps are replaced by integrated electronic detonators. These new delay blasting caps contain an electronic capsule and capacitive discharge system which replace the presently used delay element. It is contemplated that these new delay detonators be produced with the same physical dimensions as, if not smaller than, presently manufactured delay blasting caps.

It is important to keep the layout of a new initiation system as simple or simpler than the system it is designed to replace. This is imperative in order to gain rapid acceptance by blasting personnel and to eradicate the need for extensive retraining. For these reasons the delay element should, if at all possible, remain within the blasting cap.

An important concept to consider in the design of an integrated electronic detonator of the present invention (IED) is that it need only have two wires and therefore arrays of such devices would be designed simply to be wired together in parallel. In addition, a very large number of different delays could be initiated using the present standard two blasting lead wire system.

To initiate an array of IED's, a predetermined procedure is followed. However, it will not be necessary for operators to be concerned with this as it will be automatically carried out by the microcomputer firing console of FIG. 1.

As shown in FIG. 1, firing console 11 and DC power supply 13 are connected to any number N of integrated electronic delay detonators 15A, 15B, . . . and 15N. Wire pairs of inexpensive twisted pair conductors 17A, 17B, . . . 17N are connected in parallel from the respective integrated electronic delay detonators. DC power switch 19 connects battery 21 through inductor 23 to the twisted pair conductors. Capacitors 23 and 25 isolate firing console 11 from the DC level from battery 21, and inductor 23 prevents the low impedance of battery 21 from loading down the high frequency pulses emanating from firing console 11 to permit communication to the integrated electronic delay detonators 15A, 15B, . . . and 15N.

Firing console 11 is an inexpensive microcomputer having a microprocessor central processor (CPU) 31 and a terminal 33 having the usual CRT and keyboard connected to CPU 31 along main bus 35. Read-only-memory (ROM) 37 holds the firing console program and security code information which is secret even from the normal authorized user. Random access memory (RAM) 39 holds information input from the keyboard and provides memory locations for calculations and formation of communications to be sent in serial from the system by means of asynchronous communications interface adapter (ACIA) 41.

Figure 2:
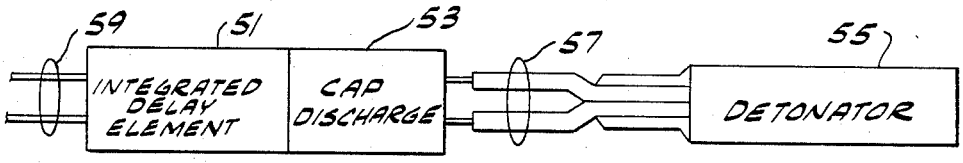
FIG. 2 is a depiction of a detonator having an adjacent integrated delay unit.

In FIG. 2 an integrated electronic delay detonator in one embodiment is made of an integrated delay element 51 such as an integrated circuit fabricated together with a capacitor 53. A detonator 55 is connected to the integrated delay element 51 through conductor pair 57. Twisted pair 59 connects to a firing console in the manner of twisted pair 17A of FIG. 1.

Figure 3A:
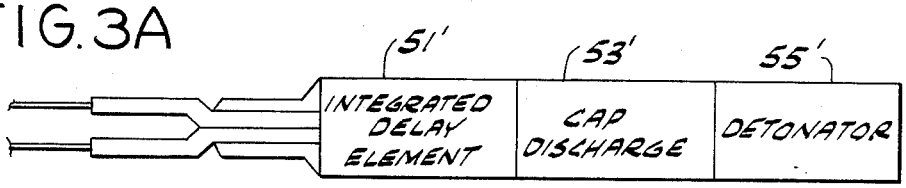
FIGS. 3A and 3B are diagrams of alternative arrangements wherein all parts of an integrated delay detonator are even more closely positioned.

In FIG. 3A an integrated electronic delay detonator in another embodiment has an integrated delay element 51' and capacitor 53' more closely mounted to a detonator 55'. A bridgewire (not shown) embedded in the detonator is heated by electricity from the capacitor 53' and used to make the detonator 55' explode.

Figure 3B:
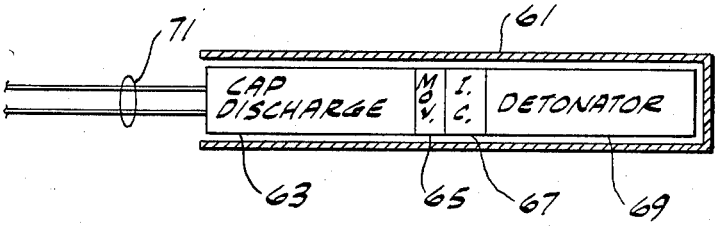

In FIG. 3B a preferred form of the integrated electronic delay detonator is shown in somewhat greater detail. Metallic shell 61 surrounds capacitor 63, metal oxide varistor 65, integrated delay circuit 67 and detonator 69. Twisted pair 71 leads to varistor 65 and integrated delay circuit 67. The varistor suppresses transients and overvoltages which can occur from electromagnetic interference and electrical effects of preceding explosions of other detonators. Integrated delay circuit 67 provides the programmable delay, security features, and control of capacitive discharge from capacitor 63. Deposited on integrated delay circuit 67 is the bridgewire and some match explosive itself next to the detonator 69.

Referring again to FIG. 1, first, d.c. current from battery 21 is supplied to the IED's of the type shown in FIG. 3B in order to activate their microcircuitry in the integrated delay circuit 67. Once this is performed, a command may be given to power up their capacitive storage devices such as capacitor 63. On the IED chip such as circuit 67, charging progress is monitored. When power storage is complete, the electronic timing delays within each IED will be initiated at precisely the same time by a complex firing code issued by the firing console 11 after a firing button is depressed by the operator.

If, however, something is shown to be wrong by the firing console 11, the operator may power down the IED power storage units such as capacitor 63 by issuing an abort command, thus rendering the IED's harmless before disconnecting the firing console 11 from the firing circuit.

A timing precision of approximately ±10 microseconds is readily achievable for the microelectric circuits to be placed within the integrated electronic detonator. Such precision is much greater than the precision of the best commercially available zero delay blasting caps which have spreads in the order of ±1 milliseconds. Incorporating such zero delay blasting caps in the integrated electronic detonator limits precision to that of the fastest zero delay blasting cap, as the error of the electronic circuitry is negligible in comparison.

If greater accuracy is desired, a faster and more precise detonator is utilized in conjunction with the electronic microcircuitry.

For safety, the IED is made such that direct current passing through the circuit does not initiate the device, initiation only being possible by the use of the correct signal. This eliminates accidental initiation caused by stray currents, electromagnetic fields, radio waves, static electricity, etc. However, in order to protect the microchip from accidental burn-out due to current or voltage overloading in such a situation, a voltage regulating device and an associated transient suppressor such as a varistor 65 is provided.

Security

Due to the extremely high density of microelectronic components that may be placed on a microchip, there is more than adequate space available for the inclusion of security functions as well as standard timing and firing circuits.

At the present time electrical blasting caps that go astray or are stolen may unfortunately be initiated by unauthorized personnel, who may include such individuals as those with criminal intent, inadequate knowledge, and children, by the use of any medium sized battery or sufficient quantity of smaller batteries connected together. This type of usage creates high risks of injury to people and damage to property.

For the purpose of security, a dual binary security code is used in the preferred embodiment of the invention. The first portion/segment of the code is unique to the user or manufacturer (Factory code). To eliminate unauthorized use this code is kept secret with only the manufacturer knowing the combination. The user need not know this code as it is integrated in the software control program supplied by the manufacturer with the firing console. This facilitates an easy change of security codes if this at any time becomes appropriate.

The second part of the security code is the unit identification code, which is necessary for enabling the functions of the integrated delay circuit which are either specific to an individual unit to the exclusion of all others, or which involve responsive transmission to the firing console from one integrated delay circuit which would be interfered with by simultaneous transmission from any other integrated delay circuit. Also the unit identification code provides advantageous flexibility when it is preferred but not technically required to provide for individual and consecutive access to the detonators, instead of executing commands from the firing console in each of the integrated delay circuits in a detonator array on a simultaneous basis.

Because the security code controls the powering-up of the appropriate discharge circuits until this command has been given, the detonator cannot be energized and fired. Thus the blasting cap will not fire when linked up to any d.c. or a.c. power source. To fire the detonator or a series of these detonators, one would therefore have to have in their possession not only a firing console made or marketed by the manufacturer of the detonator, but one that is compatible with the detonators one is going to use, i.e., the firing console or consoles belonging to the authorized explosive user or company. To stop unauthorized use of the firing console, the fire control program requires a single user security code for usage. This code is prearranged so as to be only known by the authorized blasting personnel and is programmed into the firing console on the site.

The IED is designed to be incompatible with the telephone system so that theft of an entire system does not permit criminal remote control usage over telephone lines.

For obvious economical reasons the cost of production of any range of manufactured items will be minimum if:

(a) the minimum number of components is incorporated in each unit;

(b) there is a maximum number of interchangeable components that can be utilized in the construction of each different unit;

(c) all units may be assembled on the same production line.

By the use of a single chip (FIG. 4) which is programmable to any required delay time with outstanding accuracy, the IED satisfies all of the three above conditions. Thus it would be only necessary to have one production line (perhaps with an additional one in standby mode for back-up purposes) which would not need to be changed or modified for the production of different delay series.

When delay time is not programmable as in the prior art, a wide range of extensive stockpiles of blasting caps have to be kept as it is only economical to make large runs of any one delay of the product at one time. However, with the IED it is be possible to program any integrated delay detonator unit with identical economy to large production runs as a constant flow of IED will be being produced.

IED construction in some embodiments advantageously includes three leg wires, two long ones for power and firing purposes, and the third solely for factory programming which is clipped and sealed after this process. If, however, programming in the field is required, the third wire may be left intact for later programming. For such purposes, microchip construction should facilitate a standard time delay default of zero to ensure that the IED would detonate if fired when it had failed to be delay programmed.

Another advantage in producing such an integrated delay detonator is that it lends itself to production by computer controlled full automation thus totally eliminating the production line risk to personnel except for routine maintenance. In addition, this concept allows the production of detonators of any delay time economically in any number from a single box upwards on a single computer-controlled production line which would be an integral part of a completely computer-controlled order, production, and distribution network.

It is not just important to discuss solely the IED but the system as a whole, including the computer-controlled production line system, the firing console, and the interaction that is made possible by the microchip between all three system units. The main important items that should be considered are discussed as follows:

The advantage of having a microcomputer type firing console is that the extensive software can be written for the firing program and for other uses which will become readily apparent. Firstly, one is able to have available at the touch of a key interaction between the firing console and IED in the blasting pattern. Status checks include delay and numbers of detonators present, individual statuses such as arming, power storage, delay checks, etc., and, of course, a disarming or power-down command to render all of the detonators safe in the event that a manual firing circuit check has to be made.

Secondly, training software would be made available and the firing program designed to be simple to use and user friendly. This software is provided in the form of ROM packs (Read Only Memory-microchips) for updating ease. Such software training packages can eliminate the need for blasting personnel being sent to retraining courses, eliminating extra cost and lost mantime. Such programs can even test the personnel as well as teach them and thus finally pass them out and permit them to use the firing console in the true firing mode after several successful simulations.

Thirdly, it is possible, utilizing the firing console, to keep computerized blasting records which may be easily transferred to other data storage systems. For instance, in most mining situations, identical amounts of explosive are used in each hole, therefore by keeping a record of the detonators fired an extra check can be made on the approximate use of explosives and blasting agents. Computerized blasting records may also include graphic illustrations of the layout of blasting patterns and their geographic location in conjunction with exact amounts of explosives used. Date, time, etc. would be automatically recorded along with the detonator delays and numbers by the firing console.

Finally, as in the use of bar codes in supermarkets throughout the country, automatic ordering can be made computer-to-computer whenever stores of any delay period become low and thus may be rapidly restocked in advance of shortages without need for the manufacturer to carry extensive stockpiles.

Figure 4:
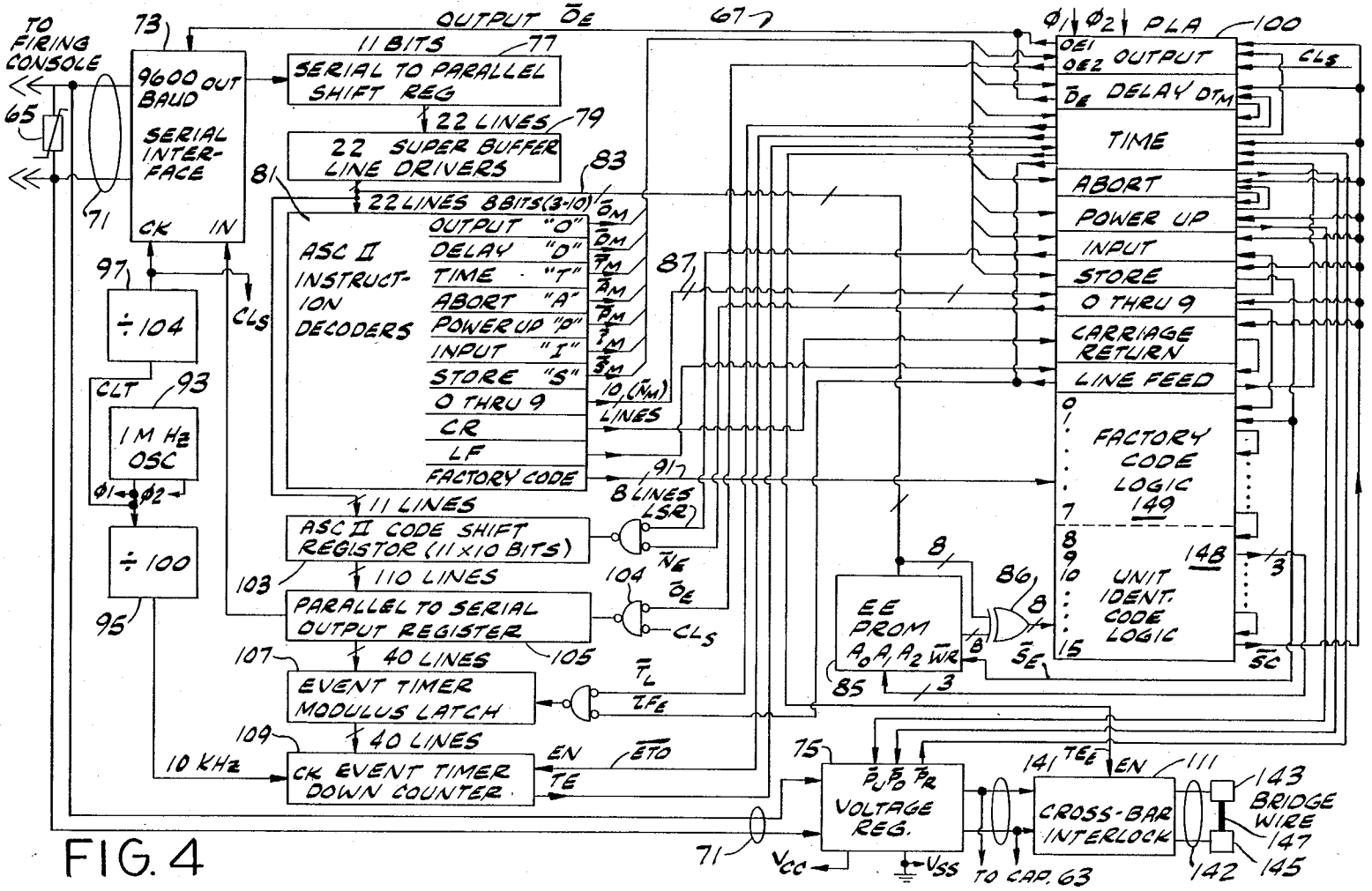
FIG. 4 is a block diagram of a semicustom integrated circuit for use in the integrated delay detonators of FIGS. 2 and 3.

In FIG. 4 a block diagram of the circuitry for an integrated delay circuit 67 of FIG. 3B is shown. Communications in serial digital form from firing console 11 arrive on twisted pair 71 to a 9600 baud serial interface unit 73 and voltage regulator 75. The communications arrive in a stream of bits corresponding to characters in the well known ASCII code. Each character in ASCII is transmitted as a byte of 8 bits preceded by 2 one-bits and followed by a one-bit in the serial communications format. See FIG. 4B. The bits enter serial-to-parallel shift register 77 which is 11 bits long. The register 77 has outputs and 11 complementary outputs for a total of 22 lines provided to ASCII instruction decoders 81 through 22 super buffer line drivers collectively designated 79. Also the bits 3–10 corresponding to the character being sent are supplied on an 8 bit bus to an electrically erasable programmable read only memory 85 described later in connection with the security code features of the invention.

The ASCII instruction decoders 81 is a set of digital decoder circuitry for providing active-low outputs (shown on right side of decoders 81) respective to arrival to ASCII characters relating to an Output Command ("O"), a Delay Command ("D"), a Time Command ("T"), an Abort or Power Down Command ("A"), a Power Up Command ("P"), an Input Command ("I"), ASCII numerals zero "0" through "9", a Store Command ("S"), Carriage Return character ("CR"), Line Feed character ("LF"), and each of illustratively eight ASCII characters in a predetermined and prewired code called the "Factory Code" in FIG. 4. In general, bits are being shifted through the shift register 77 at the 9600 baud rate. Decoders 81 are looking for a match of the contents of the shift register 77 with particular ASCII characters within the 2 leading and one trailing bit in the format for which the decoders 81 are respectively hardwired. Decoders 81 have logic which is sufficiently fast to easily keep up with decoding the shift register 77. When a match is found, a respective output line from the decoders goes low, as suggested for the command decode lines marked $O_M$-bar, $D_M$-bar, $T_M$-bar, $A_M$-bar, $P_M$-bar, $I_M$-bar, and $S_M$I-bar. The subscript "M" is meant to indicate "match." Ten lines emanate from ten decoder outputs for the ASCII numerals "0", "1","2", and "9". These ten lines are collectively indicated as bus 87 by a slash. If for example, the numeral "5" appears in its ASCII code representation in bit positions 3–10 of shift register 77 preceded by two one-bits in positions 1 and 2 and followed by a one-bit in position 11 of register 77, then the single one of the ten lines in bus 87 corresponding to numeral "5" goes low, and all other outputs of decoder 81 remain high. Similarly if the ASCII code for carriage return appears in register 77, then the output from section "CR" of decoders 81 goes low and all other decoder outputs remain high. The same comment applies to the line feed "LF" character.

Eight outputs are illustratively provided from decoders 81 for eight bits of a hardwired factory-provided portion of a security code. These eight outputs emanate from decoder section on an eight-line bus 91. It is noted that for economy of space on the drawing, the decoder sections "0–9" and "Factory Code" are drawn about the same size as, for instance, the decoder section for the letter "O" for decoding the Output Command. However, it is to be emphasized that decoder section "0–9" is actually ten decoders and not just one, and that the decoder section "Factory Code" is actually eight decoders and not just one.

The outputs from the decoders 81 are provided to correspondingly named sections of a programmed logic array (PLA) 100. PLA 100 is wired to implement the logic, which is sequential logic, needed to provide enabling outputs to serial interface 73 (Output Enable $O_E$-bar), ASCII code shift register 103 (Load Shift Register LSR-bar and Number Match $N_M$-bar), parallel-to-serial output register 105 (Output Enable $O_E$-bar), event timer modulus latch 107 (Line Feed Enable $LF_E$-bar and Time Latch $T_L$-bar), event timer down counter 109 (Elapsed Time Output Enable ETO-bar), voltage regulator 75 (Power Up PU and Power Down PD), cross-bar interlock 111 (Time Elapsed Enable $TE_E$-bar), other sections of PLA 100 (Security Enable SE-bar), and EEPROM 85 (Store Enable $S_E$-bar).

Figures 4A, 5:
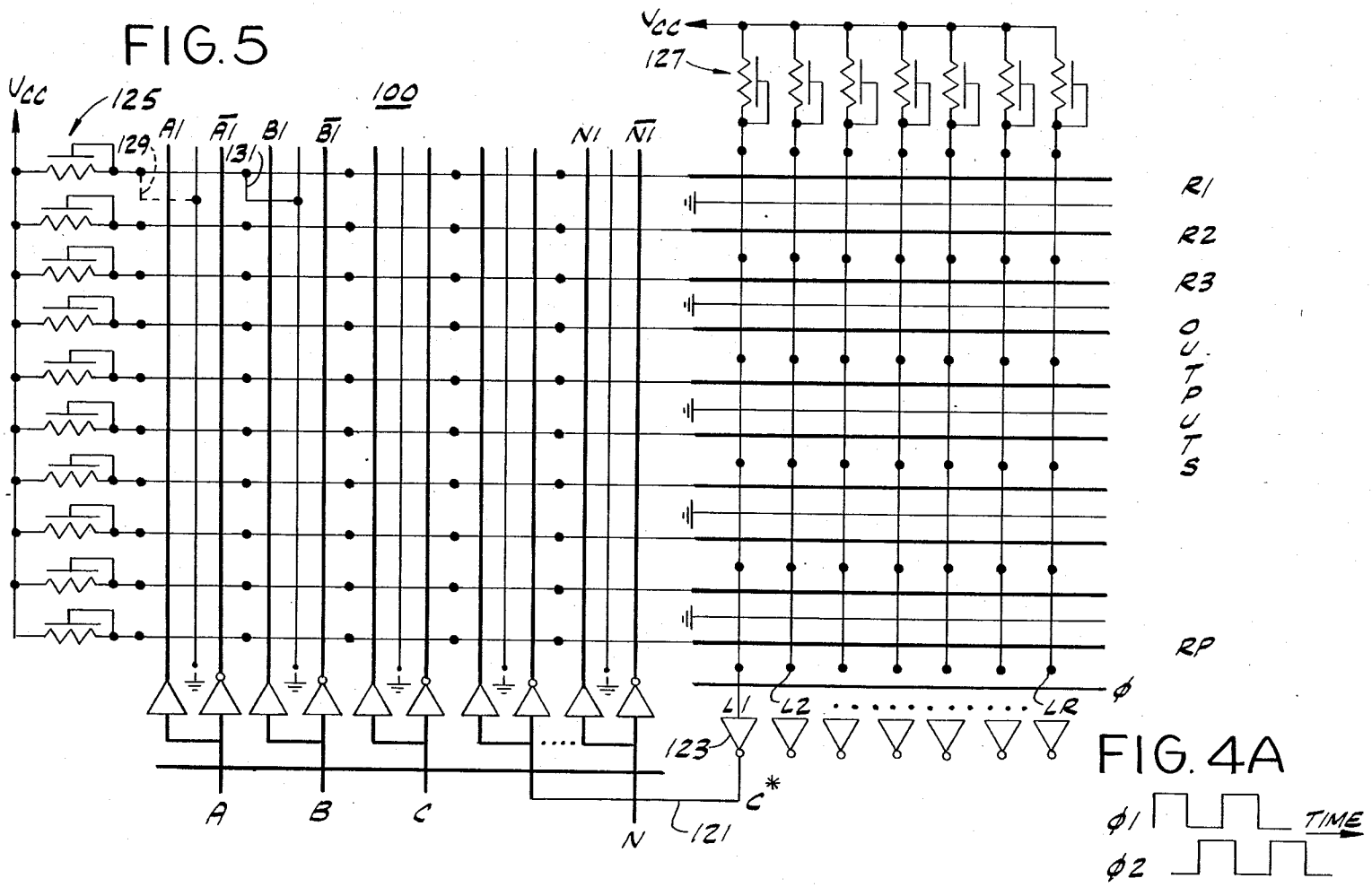
FIG. 4A is a timing diagram of clock waveform phi-1 and clock waveform phi-2.
FIG. 5 is a diagram of a programmable logic array for use in the semicustom integrated circuit of FIG. 4.

FIG. 5 shows an illustration of PLA 100 in blank on an integrated circuit chip. Input lines A, B, C, . . . N are provided for all the inputs to the PLA 100. Both inverting and noninverting amplifiers are provided from each input to respective lines A1, A1-bar, B1, B1-bar, . . . N1, N1-bar. Output lines R1, R2, R3, . . . RP are provided. Sequential logic is implemented by appropriately connecting the outputs back to the inputs by means of intermediate lines such as 121 emanating through inverters 123 from lines L1, L2, . . . LR. Pullup resistor groups 125 and 127 deposited on the chip service the output lines and the intermediate lines respectively. Complementary metal oxide semiconductor (CMOS) field effect transistors (FETs) such as FETs 129 and 131 are deposited across lines A1 and B1 to ground thereby to implement an illustrative two input logic gate. It is to be understood that the technology for designing (programming) the arrangement of deposited FETS and the connections of outputs to inputs through the intermediate lines is well known to the integrated circuit design art. Accordingly, the details of the PLA 100 are omitted for brevity without sacrifice of disclosure.

In programming PLA 100, the skilled worker utilizes FIG. 4 together with the present detailed description, and diagrams in FIGS. 6A–6I called state diagrams showing how the functions are to be implemented in the PLA 100. For a textbook discussion of the design procedure employed by the skilled worker see, for instance, *Introduction to VLSI Systems* by C. A. Mead and L. A. Conway, Addison-Wesley Publishing Co., Inc., 1980, pp. 78–88.

Figures 4B, 4C, 7, 8:
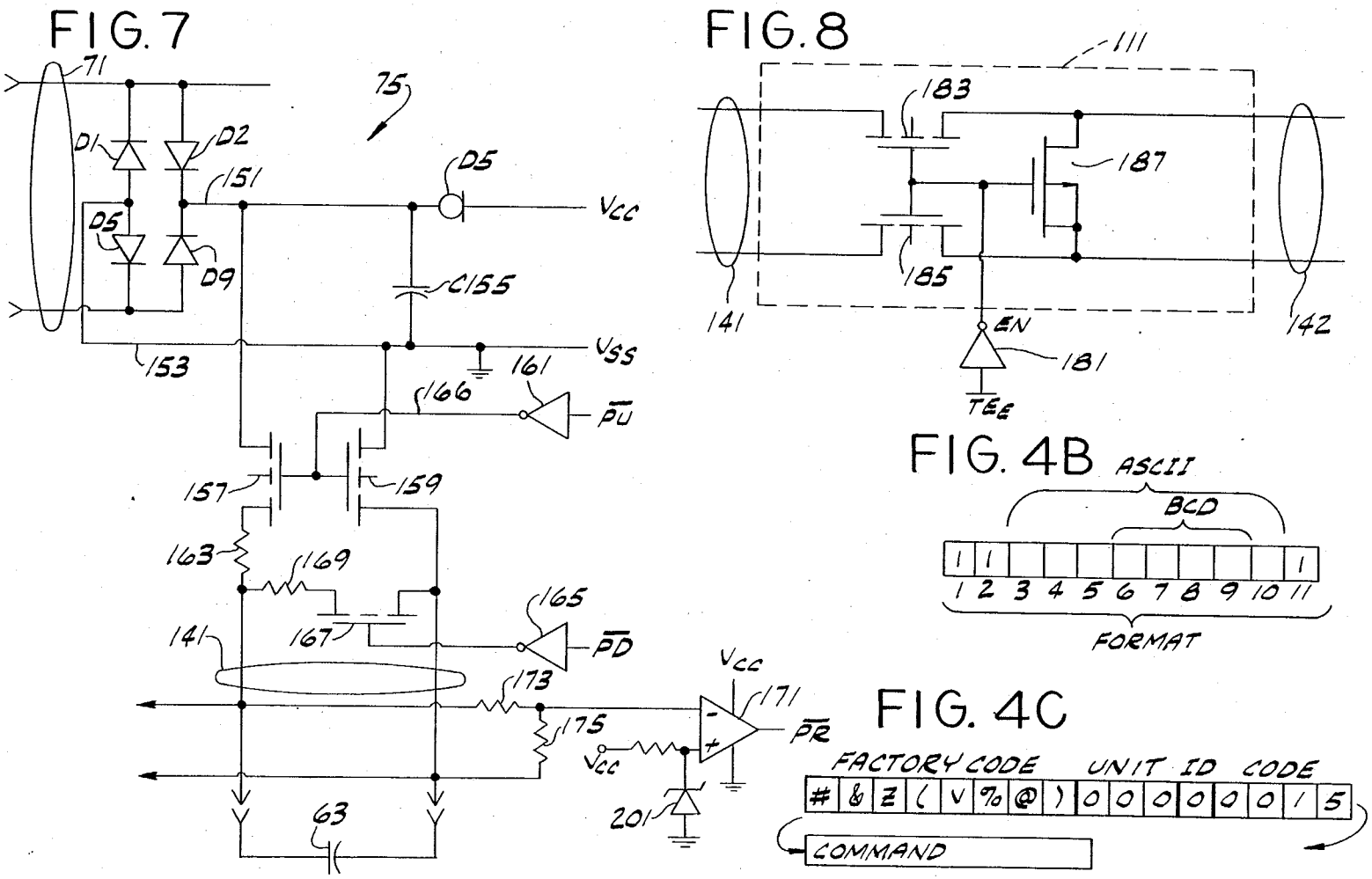
FIG. 4B is a diagram of serial format for a single ASCII character.
FIG. 4C is a diagram of a security code and command sent by the firing console to a detonator in a preferred embodiment of the invention.
FIG. 7 is a schematic diagram for a voltage regulator circuit for use in the integrated circuit of FIG. 4.
FIG. 8 is a schematic diagram of a circuit for use as a cross-bar interlock in the integrated circuit of FIG. 4.

It is contemplated in this preferred embodiment that all commands from the firing console are to be preceded by an illustratively 16 character security code, shown in FIG. 4C, consisting of a first 8-bit Factory Code portion which is stored in the firing console 11 and is unknown to the normally authorized operator of the system. The second 8-bit portion is a unit identification code portion which is used to address or designate a specific integrated delay detonator unit in the commands Input, Output, Delay, and Store. The use of the unit identification code portion is programmed in the firing console to be optional in connection with the commands Power Up "P" and Abort "A". The firing command "T" is preferably general to all of the integrated delay detonators. It is contemplated that units coming from the factory are all responsive to all zeros or all ones or some other predetermined configuration which is disclosed to the authorized operator of the system.

Background information on EEPROMs is found, for instance, in *E2Prom Family Applications Handbook*, Intel Corporation, 1981. EEPROM 85 communicates by an 8 line bus through 8 exclusive-OR gates 86 to the eight respective inputs to unit identification code logic section 148 of PLA 100. Each of the eight exclusive-OR gates 86 acts as a comparing or matching device to compare each output bit from EEPROM 85 with the corresponding bit in an incoming ASCII numeral derived from lines 3 through 10 from the line drivers 79. When any command is received, it is recalled that the first 16 bytes are the 8-byte Factory Code followed by the 8-byte Unit Identification Code. The Factory Code is illustratively comprises of nonnumeric characters other than the characters selected for designating Commands. These characters are decoded in the Factory Code decoders (8) in decoders 81, which communicate by eight lines to the Factory Code logic portion 149 in PLA 100.

The Factory Code logic portion 149 and Unit identification code logic 148 constitute a Security Code logic portion of PLA 100 having inputs designated in FIG. 4 as 0,1,2, . . . 15. The Security Code logic portion 148,149 is programmed in its electronic construction so that a Security Code Enable SC-bar line will only have a low output when and after a precise sequence of input lows on every input line in numerical order occurs, i.e. consisting of low on input 0, followed by low on input 1, followed by low on input 2, . . . followed by low on input 15. EEPROM 85 is constructed so that when it is not being written, writing occuring only during the Store Command "S", it is able to be read by applying the bits from the line drivers 79 to EEPROM 85. When the characters of unit identification information correspond to the unit identification previously stored in EEPROM 85, then EEPROM 85 outputs a low on the one of its 8 output lines connected respectively to logic 148 inputs 8,9,10,11,12,13,14,15 which corresponds to the ASCII character just received.

When the detonators are set up in the field, it is contemplated that they be individually provided with unique unit identification codes by means of the Store Command "S". When "S" is received, the decoders 81 set the $S_M$-bar output low. PLA 100 in response asserts Store Enable $S_E$-bar line low to the Write Enable WR-bar input of EEPROM 85 and also to the Security Code logic 148,149 which sequentially produces binary addresses for each of 8 bytes in the EEPROM on a three-line address bus 146 as ASCII numerals are received on decoders 81. The ASCII numerals are derived as 8-bit groups from lines 3 through 10 from the line drivers 79 and stored from bus 83 one by one in respective bytes of the 8-byte EEPROM 85. In this way the unit identification information is stored in EEPROM 85.

The Input Command "I" tells the PLA 100 that a ten character delay interval magnitude, herein called a modulus, is going to be next sent from the firing console 11 of FIG. 1. This enables ASCII code shift register 103 which receives 11 bits from the line drivers 79 corresponding to the first numeral (which is 0 to 9) of the delay expressed in delay resolution units of 100 microseconds. As the succeeding numerals are received they are fed into the shift register 103 and the previous numerals are shifted in response to the "0 thru 9" section of the PLA 100. When ten numerals have been received, the shift register 103 has all 10 of its 11 bit numeral code sections filled. 110 lines feed the numerals to register 105 which holds them in parallel form.

If an Output Command "O" is received, the register 105 is fed with sufficient clock pulses $CL_S$ at the 9600 baud rate through gate 104 during Output Enable $O_E$-bar to send the 10 digit delay stored therein through serial interface unit 73 back to firing console 11. This access to register 105 is nondestructive so that the delay remains stored therein even after the register 105 is read in this way.

The ASCII code for numerals consists of a four bit binary-coded-decimal (BCD) portion in the 11 bit string for each numeral, as will be recognized by the skilled worker. This feature is used to advantage by deriving each of the four-bit BCD portions for the 10 numerals in register 105 and latching them through 40 parallel lines into event timer modulus latch 107, which suitably is an electrically erasable device in the nature of an EEPROM, when the Time Latch Enable $T_L$-bar and Line Feed Enable $LF_E$-bar occur. This occurs when firing of the detonator has been called for by the firing console by issuing a Time Command "T" followed by Line Feed.

Event timer down counter 109 is of a familiar type which receives the modulus in BCD, and down counts at a 10 KHz. rate set by clock pulses $CL_T$ when Elapsed Time Output Enable ETO-bar is received. When the counter 109 has reached zero, it issues a Time Elapsed signal TE to the Time section of PLA 100.

The timer down counter 109 generates a precise time delay reference that is an output through PLA 100 and cross-bar interlock 111 to an explosive detonator. A serial output from register 105 is used to provide a feedback reference to the programming device such as firing console 11 to adjust the timer modulus to correct for any deviation in the event timer's time base. It is recognized that manufacturing differences in the clock rate of oscillator 93 between different integrated delay detonators can affect the order of detonation. Assume, for instance, that one detonator is to fire 0.1 second after the fire command "T" is given and that two others are to fire at 1.8 and 1.85 seconds.

In such case, the two others may fire in reversed sequence if manufacturing differences depart sufficiently from nominal. The Delay Command "D" differs from the Output command in that it delays the transmission of the modulus back to the firing console 11 for a period of time taken by testing the down counter 109 by counting it down to zero. In this way, the firing console can obtain the information it needs for compensating for different clock rates in different integrated delay detonators. Firing console 11 is for such applications programmed in part to act as a stopwatch. The stopwatch begins counting on the last bit in the 11 bit code of the "D" in the Delay Command that it transmits to integrated delay circuit 67. The stopwatch stops counting on the first bit of the response to the Delay Command received from the integrated delay circuit 67. Then the firing console can compensate keyboard input delay modulus values and send adjusted modulus values to the respective integrated delay detonators so that they will fire in correct sequence.

The Power Up Command "P" arms the integrated delay detonator. The $D_M$-bar output from decoders 81 goes low. The Power Up section of the PLA 100 issues a low to input PU-bar on voltage regulator 75 charging capacitor 63 off-chip. If a fire command "T" is given, the detonator will be exploded.

The Abort/Power Down Command "A" disarms the integrated delay detonator if the firing console operator deems a previously given "P" command to be premature, or if it is desired to affirmatively discharge capacitor 63. When "A" is received the decoders 81 issue a low on line $A_M$-bar, any power up PU-bar signal is terminated in the Power Up section of PLA 100, and the Abort/Power Down section of PLA 100 issues a low Power Down signal PD-bar to voltage regulator 75.

The Fire Command is entered into the firing console 11 by several keystrokes sufficient in number and complexity to indicate that the operator is deliberate in intention. The firing console then sends the fire command as the ASCII code for the letter "T" followed by the Line Feed character. If the integrated delay circuit 67 has previously been armed by the "P" command, the occurrence of a low output $T_M$-bar from decoders 81 causes the sequential logic in PLA 100 to issue the Time Elapsed Enable $TE_E$-bar to cause cross-bar interlock 111 to transfer the energy stored in capacitor 63 to bridgewire 147 and explode the detonator.

Figure 6A:
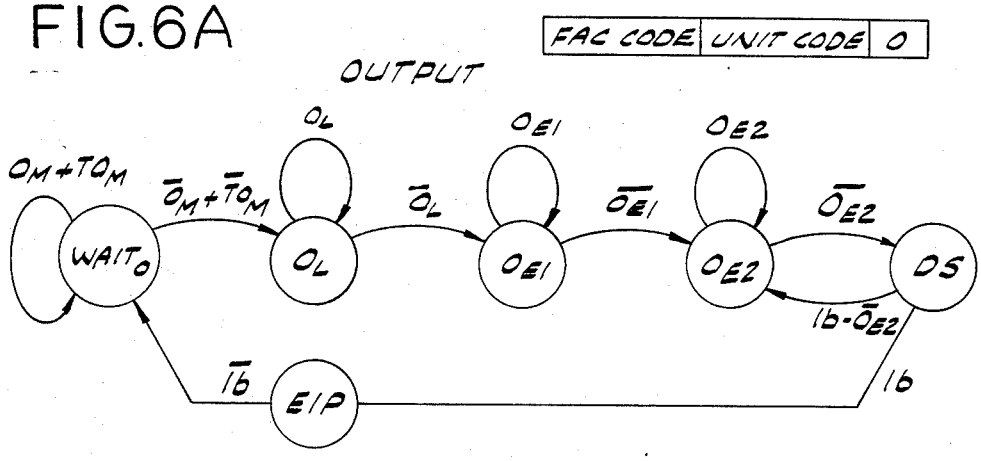
FIGS. 6A–6I are command formats and state diagrams for use in defining the logic for the programmable logic array (PLA) of FIG. 5.

In FIG. 6A, the state diagram for the Output Command is given and its format is shown in the upper right.

The glossary of symbols for FIGS. 6A–6I is as follows:

Glossary 6A lb: last bit
DS: Digit Shifter incrementer
$O_L$: Output code state latch
DI: Delay code Initiated output
$TO_M$: Time code initiated Output Match Glossary 6B

STP: Start Timer PLA
$DTE_e$: Disable $TE_e$ line
$D_L$: Delay code state latch
$DT_M$: Delay Time Match
DCI: Disable Cross-bar Interlock Glossary 6C

$CR_M$: Carriage Return character match
$LF_M$: Line Feed character match

Glossary 6D

$A_M$: Abort Match
$A_L$: Abort code Latch state
PU: Power Up signal to voltage regulator
PD: Power Down to voltage regulator line enable Glossary 6E

$I_M$: Input Match
$I_L$: Input code latch state
$N_M$: Number Match state (is the 10 numeral decoder outputs OR-ed together)
LSR: Load Shift Register enable
lb: last bit
DS: Digit Shifter Incrementer
EIP: Enable Instruction PLAs Glossary 6F

Figure 6B:
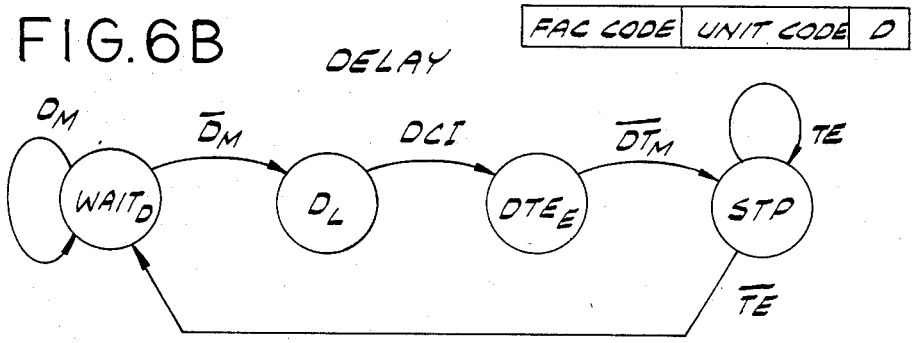
Figure 6C:
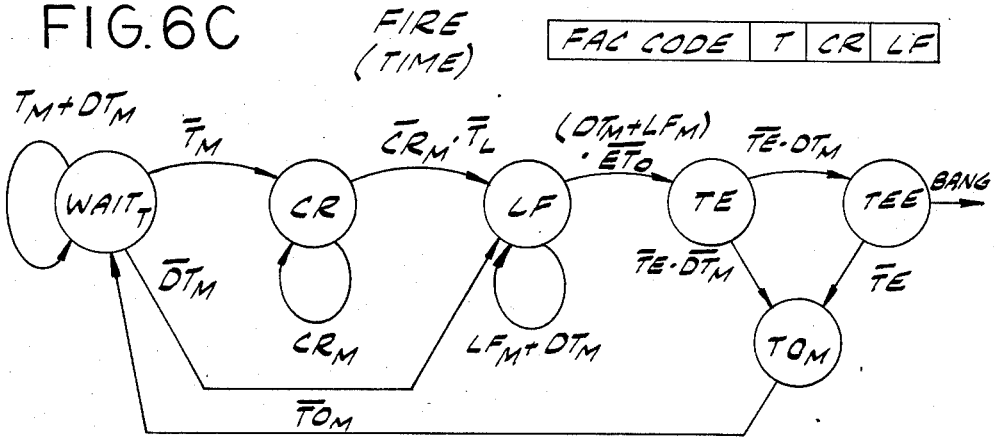
Figure 6D:
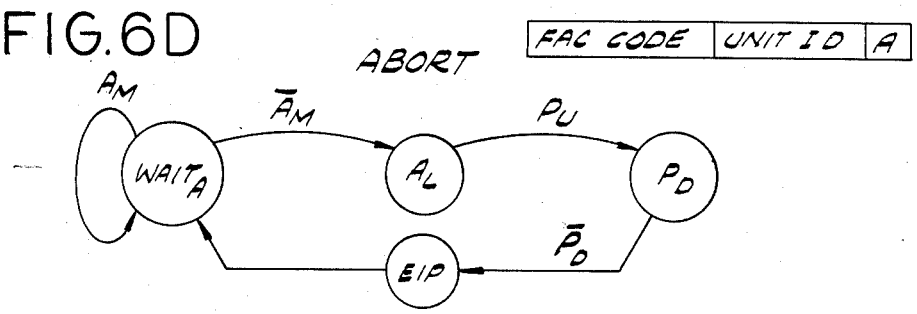
Figure 6E:
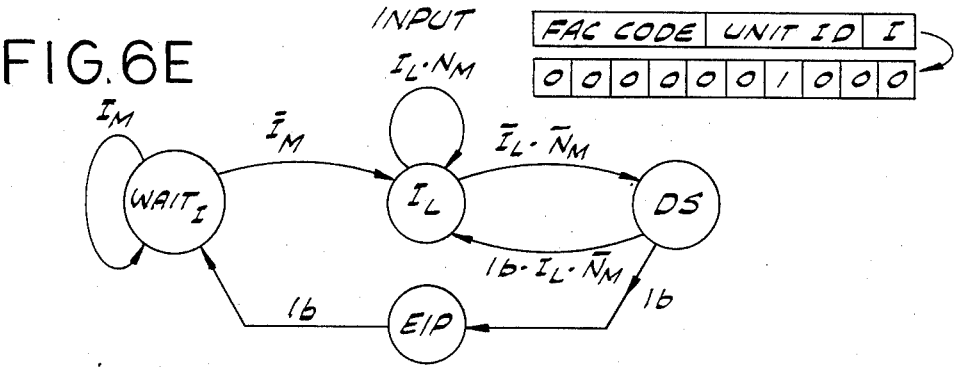
Figure 6F:
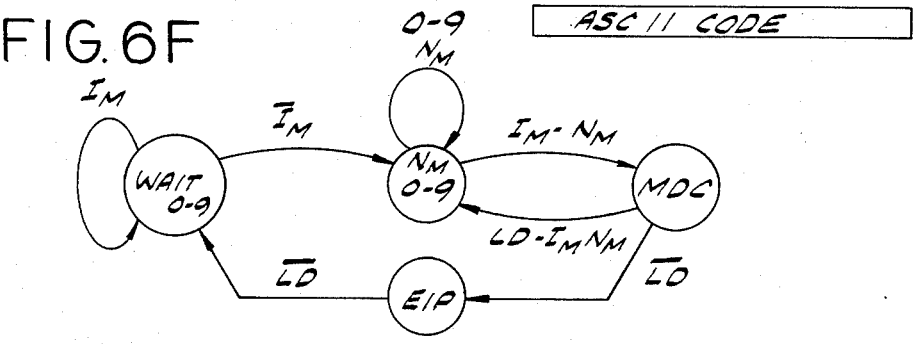

(There are 10 decoders for numerals 0 through 9 respectively so FIG. 6F actually represents 10 state diagrams for the 10 PLA sections corresponding to the 10 numeral decoders.)

$I_M$: Input Match
$N_M$: Number Match
MDC: Modulus Digit Counter
LD: Last Digit for Event Timer Down Counter
EIP: Enable Instruction PLAs Glossary 6G

$S_M$: Store Match
S: Store Code Latch State
$N_M$: Number Match
EEADI: EEPROM Address Incrementer
LB: Last Byte
EIP: Enable Instruction PLAs Glossary 6H

$P_M$: Power Up (Arm) Match
$P_L$: Power Up Code Latch State
$P_D$: Power Down (disables power down line to voltage regulator)
$P_U$: Power Up (enables power up line to voltage regulator)
$P_R$: Power Ready (capacitor has been charged)
EIP: Enable Instruction PLAs Glossary 6I

DET: Disable Event Timer $TE_e$ line to cross-bar interlock
SCE: Security Code Error
ETP: Enable Time PLA
E-bar: Error in the security code (E=EFC OR EUIDC)
UIDSC: Unit Identification Scan Complete
IINC: Instruction INComplete
EIP: Enable Instruction PLAs
EUIDC: Error in Unit Identification Code
UIDCSC: Unit IDentification Code Scan Complete
$F_{M7}$: The last Factory Code character, on match line 7
CFC: Correct Factory Code
SSUIDC: Sequentially Scan Unit IDentification Codes
EFC: Error in Factory Code
FCSC: Factory Code Scan Complete
SSFCD: Sequentially Scan Factory Code Decoders
$F_{M0}$: The first Factory Code character, on match line 0
F: Factory code In FIG. 6A for the Output Command, the logic is starting in a WAIT state. When an output match or a time code initiated output match occurs, the output code state latch is entered. When exit occurs from the $O_L$ state, the $O_{E1}$ state enables the output line to serial interface 73 in FIG. 4. The next state $O_{E2}$ enables the parallel to serial output register, see gate 104. The Digit Shifter incrementer is toggling back and forth as indicated by the circulating arrows joining states $O_{E2}$ and DS. When the DS state has counted the last bit in the parallel to serial output register 105, then rather than toggle it exits to Enable Instruction PLAs state and then returns to the Wait State.

In FIG. 6B, for the Delay Command, exit occurs from the WAIT state when a Delay Match signal is received from decoders 81 of FIG. 4, causing the Delay Code latch state to be achieved. Exit occurs from the Delay Code latch state on next cycle of the phi-1 clock to the Disable $TE_e$ line state so as to prevent initiation of the detonator since the purpose of the Delay command is to check the time base, not fire the detonator. Once the disable $TE_e$ to interlock 111 has been given, then it is safe to start the event timer down counter 109. The logic is in state STP while the event timer down counter is counting down (TE high) to zero whence the TE output of down counter 109 goes low and the system returns to its WAIT state.

In FIG. 6C, the state diagram for the Fire Command (Time) logic is shown. This command can be initiated from two different points—the time match $T_M$ line from the decoders 81 or from the delay PLA section output DTM. In a normal Fire Commmand T the T match line $T_M$-bar goes low. The system reaches state CR where it is waiting for the Carriage Return match line from decoders 81 to go low. When the Carriage Return is received, the latching signal $T_L$-bar is sent to the event timer modulus latch 107. When this task is completed, the logic advances to the Line Feed LF state and waits for the Line Feed to occur by the Line Feed decoder in decoders 81 going low. Now when the Line Feed is received, Line Feed Match $LF_M$ is OR-ed with the Delay Time Match DTM, and when the OR goes low, then the Event Timer Output is enabled (ETO-bar to event timer down counter 109). When the ETO-bar signal has been put low state TE is reached. The system remains in this state until the event timer down counter 109 has counted down to zero and output TE goes low.

If the time command has not been initiated from the Delay Command ($DT_M$ high) then the cross-bar interlock 111 is enabled in state $TE_E$. If the system has been armed, the detonator will explode, catastrophically ending the sequence. If however, the system has not been armed, then the circuit will make a transition to state $TO_M$ (Time Code initiation for an output Match Line). What follows is that the system will go through and transmit the time delay modulus as if an output command had been issued from the firing console 11, signalling the firing console that there has been a misfire.

If the time command has been initiated from the Delay Command ($DT_M$ low), then at the initial WAIT state a transition is made directly to the Line Feed state, and then on to the TE state as before-described. From the TE state a transition is made directly to the $TO_M$ state where the time delay modulus is transmitted to the firing console. Since the the TE state persists for the actual delay time interval, the transmission is delayed in time in the manner desired to give the firing console an indication of the actual time base of the circuit.

In FIG. 6D, the state diagram for the Abort (Power Down) Command is shown. The logic remains in the WAIT state until an Abort Match is received from decoders 81 whence a transition occurs to the Abort Latch $A_L$ state. A signal PU being high is issued to voltage regulator 75 disconnecting the capacitor 63 from the conductors 71, and then the $P_D$ state is reached. Next the logic issues a power down (PD-bar) signal to voltage regulator 75 and reaches state EIP to Enable Instruction PLAs. The EIP enable line (not shown on FIG. 4) is a mass enable to all the sections of PLA 100 to permit them to respond to the match line outputs from decoders 81.

In FIG. 6E, the state diagram for the Input Command is shown. The logic remains in the WAIT state until an Input Match ($I_M$-bar) is received from decoders 81 whence a transition occurs to the Input Latch $I_L$ state. The logic remains in the $I_L$ state as long as no number match is received ($N_M$ loop). When a number match has been received ($N_M$ goes low), then the $I_L$ condition is latched in because of LSR-bar in the expression LSR-bar AND $N_M$ and the system cycles back and forth between Digit Shift state DS and Input Latch state $I_L$ (arrow Ib AND LSR-bar AND $N_M$-bar) until the last bit Ib is received. When the last bit has occurred (Ib-bar), transition is made to state EIP to enable all the instruction PLA sections and the logic returns to the WAIT state.

In FIG. 6F, the state diagram for the ASCII numeral PLA sections is shown. It is emphasized that this diagram represents 10 state diagrams for 10 PLA sections respectively corresponding to the numerals 0,1,2,...9. In each case the logic is in a WAIT state until an Input Match or a Store Match ($I_M$-bar OR $S_M$-bar) is received whence it makes a transition to a state respective to each numeral PLA section designated with the numeral respective thereto. The logic persists in the numeral state until a number match $N_M$ is received from decoders 81 when it makes a transition to the Modulus Digit Counter state. The logic makes transitions back and forth between the numeral state and the MDC state until the last digit LD for the event timer down counter is obtained (tenth digit in the case of the Input Command), whence the logic provides EIP and returns to the WAIT state.

Figure 6G:
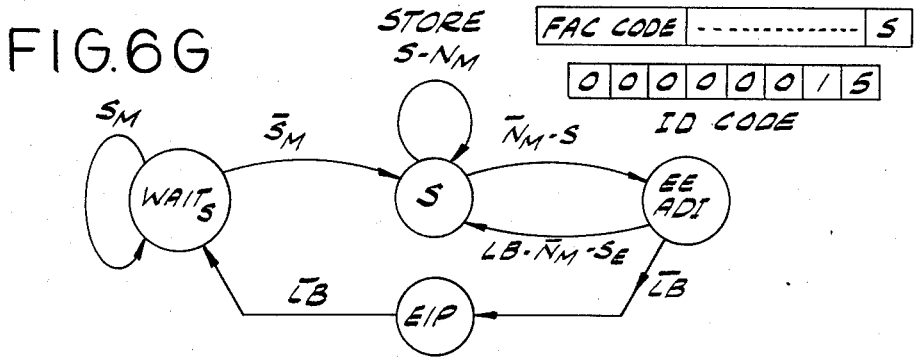

In FIG. 6G the state diagram for the Store Command is shown. Again the logic begins in a WAIT state, this time until a Store match $S_M$-bar is received from decoders 81, when the logic goes to state Store Latch $S_L$. The logic persists in state $S_L$ until Number Match goes low $N_M$-bar AND $S_L$. The logic moves back and forth between states $S_L$ and EEADI until the last byte of the Unit Identification Code for the detonator has been received. Then the logic goes to EIP and then back to WAIT.

Figure 6H:
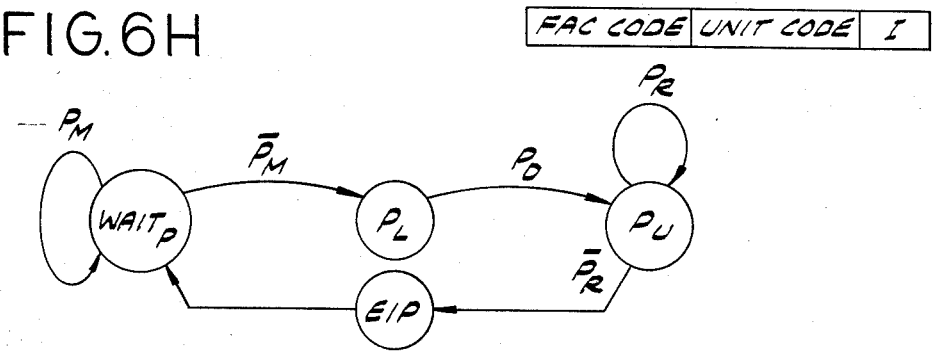

In FIG. 6H the state diagram for the Power Up (Arm) "P" Command is shown. Again the logic begins in a WAIT state, this time until a Power Up Match $P_M$-bar is obtained from decoders 81, whence state $P_L$ is reached. On the next clock cycle the Power Down (PD) line to voltage regulator 75 is disabled so as to release capacitor 63 from being shorted. Next a Power Up (PU) line to voltage regulator 75 is activated, charging capacitor 63 until the Power Ready (PR-bar) line goes low indicating that capacitor 63 is indeed charged, whence the logic returns to the WAIT state.

Figure 6I:
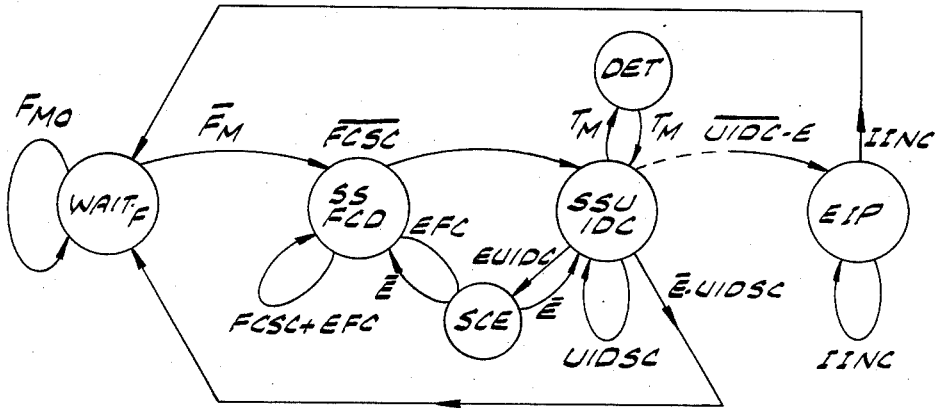

In FIG. 6I the state diagram for the Security Code sections 148,149 of the PLA 100 is shown. The logic is responsive to the Factory Code and Unit Identification Code portions (see FIG. 4C) of the transmissions from firing console 11. Again the logic begins in a WAIT state this time until the first match line for factory code character in decoders 81 goes low, whence the Sequentially Scan Factory Code Decoders state is reached. In this state the logic sequentially checks each line to see that it matches up with the incoming code from the firing console, as indicated by loop FCSC OR EFC-bar. If an error is detected, the logic enters the Security Code Error SCE state briefly to set an error E flag to indicate that the error has been detected. Then the logic returns to the SSFCD state until all of the Factory Decoders in section 81 have been scanned. Completing this task, the logic passes to the Sequentially Scan Unit IDentification Codes state SSUIDC. The logic compares the contents of each EEPROM 85 byte location with the current Unit Identification Code characters coming in from the firing console 11. A branch occurs to the SCE state if an error is detected in this section of code and the E flag is set. During the SSUIDC state the logic examines the Time Match (Firing Command) line $T_M$-bar during the first byte of the Unit Identification Code in case there is a firing command. In such case, the logic branches to the firing command PLA section marked "TIME" in FIG. 4. When the unit Identification Scan is complete and there are no errors (UIDSC-bar AND E) then the logic enables the instruction PLAs to accept commands (EIP). However, if an error has occurred (E-bar AND UIDSC-bar), the logic branches back to the WAIT state to wait for the next factory code to be sent.

In FIG. 4, voltage regulator 75 admits DC electrical energy from conductors connected to twisted pair 71 when a Power Up PU-bar low-active signal is received from PLA 100. The energy is temporarily stored in capacitor 63 of FIG. 3B through lines 141. The capacitor 63 is discharged by voltage regulator 75 if and when a low-active Power Down PD-bar signal is received from PLA 100. Cross-bar interlock circuit 111 responds to a low-active Time Elapsed Enable $TE_E$-bar signal by transferring any energy residing in capacitor 63 to conductor pads 143 and 145. These pads are connected either to an off-chip bridgewire (as in FIG. 3A) or to an on-chip bridgewire 147 as shown for use in FIG. 3B. When the energy is transferred to the bridge wire, explosive painted thereon is ignited and sets off detonator 69 in FIG. 3B.

FIG. 7 shows a circuit diagram for the voltage regulator 75. Twisted pair 71 is fed to diode bridge consisting of the four diodes D1, D2, D3, and D4, connected to lines 151 and 153 so that reversing connections of twisted pair 71 to the firing console 11 of FIG. 1 does not affect the polarity of the DC voltage supplied to the integrated delay circuit 67 of FIG. 3B. A small 0.01 microfarad capacitor C155 and a constant current diode D5 provide the chip supply voltage $V_{CC}$, and line 153 establishes the $V_{ss}$ ground reference for the chip.

Enhancement FETs 157 and 159 are normally open circuits unless a positive voltage is applied along line 160 to their gates. When a low signal PU-bar is received and inverted by an inverter 161, the resulting High turns on FETs 157 and 159 permitting capacitor 63 to charge through resistor 163 and lines 141. When a low signal PD-bar is received (Power Down), it is inverted by inverter 165, turning an enhancement FET 167 on and discharging capacitor 63 through lines 141 and resistor 169.

The condition of charge of capacitor 63 is monitored by inverting comparator 171 which is referenced to a voltage less than $V_{CC}$ by Zener diode ZD1. When the output of a voltage divider consisting of resistors 173 and 175 (which are selected to be of very high resistance so as not significantly discharge capacitor 63) reaches a voltage value corresponding to a fully charged state of capacitor 63, the comparator 171 goes low indicating by low-active output Power Ready PR-bar that the capacitor is charged. The comparator 171 is provided with hysteresis so that it goes low when the capacitor 63 is substantially fully charged and then only goes back high when the capacitor is substantially discharged.

FIG. 8 shows the cross-bar interlock circuit 111. When the detonator is to be exploded, the Time Elapsed Enable $TE_E$-bar goes low, producing a high output from inverter 181. The high output turns on enhancement FETs 183 and 185 and turns off depletion FET 187. Energy available on line 141 then passes through FETs 183 and 185 without being shorted by FET 187 and is thus transferred to conductors 142 to the bridgewire 147 of FIG. 4.

Figure 9:
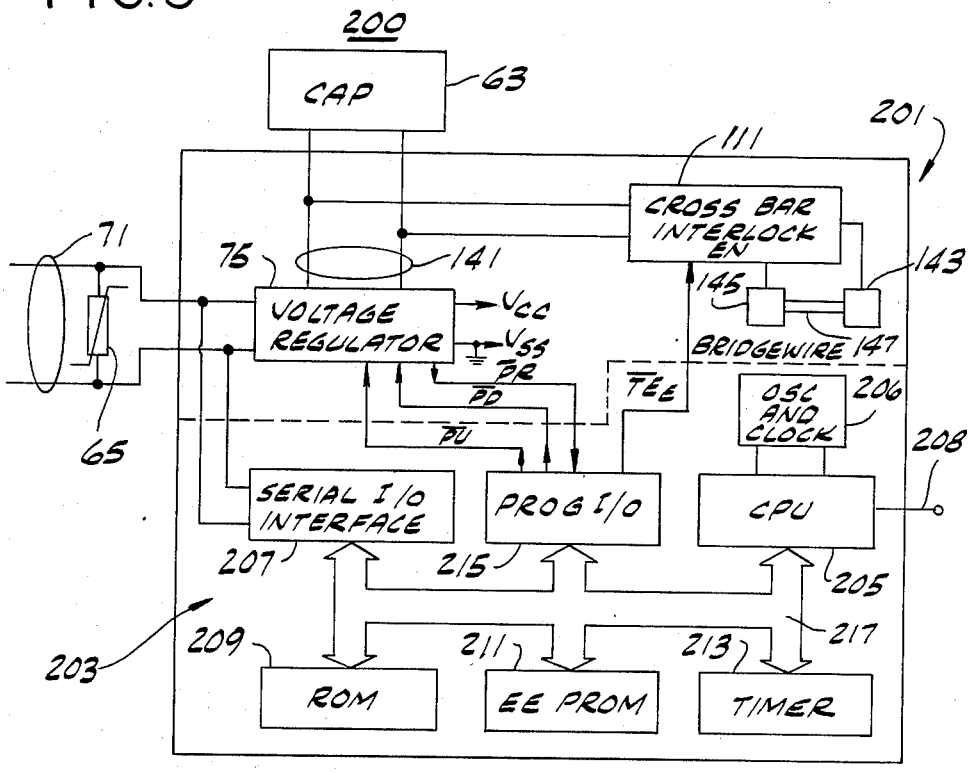
FIG. 9 is a block diagram of a microprocessor-oriented integrated circuit alternative to the semicustom integrated circuit of FIG. 4 for use in the integrated delay detonators of FIGS. 2 and 3.

FIG. 9 shows a microcomputer-oriented integrated delay circuit 200 of the integrated delay circuit for use according to the present invention. Circuit 200 includes an energy admitting, temporary storing, and transferring section 201 having voltage regulator 75, capacitor 63, and cross-bar interlock 111, numbered as in FIG. 4. Section 203 instead of being a semicustom integrated circuit as in FIG. 4 is a microcomputer having CPU 205 with oscillator and clock 206, Serial I/0 Interface 207, ROM 209, EEPROM 211, Timer 213, and Programmable I/0 215 communicating on bus 217. The ROM 209 is provided with a computer program for sensing and responding to the commands from firing console 11 of FIG. 1 in the same manner as the semicustom chip of FIG. 4. The Factory Code is stored in ROM 209. The unit code portion of the identification of the integrated delay detonator is programmed into EEPROM 211 by the program stored in ROM 209 in response to the code characters provided by a Store Command from firing console 11.

A line 208 extending from the unit for factory programming purposes is provided as a third wire in addition to pair 71. Line 208 is suitably an interrupt line to CPU 205 to cause CPU 205 to branch to a factory programming input routine stored in ROM 209. The factory programming input routine during its execution sets a flag in EEPROM 211 so that after the routine is executed once at the factory and the flag has been set, the routine cannot be executed again. Then, line 208 is clipped and sealed prior to shipment from the factory.

In an alternative embodiment of the invention, the Abort Command is able to be executed after the timing sequence for firing under Firing Command "T" has been initiated. When an abort is recognized the time elapsed line TE from down counter 109 is disabled.

In FIGS. 10, 10A, 10B, 10C, and 10D, flowcharts for the microcomputer circuitry in firing console 11 disclose a sequence of commands and operations for programming and firing integrated delay detonators of the types shown in FIGS. 4 and 9. The flowcharts presume that the operator is at left communicating with the firing console 11, as indicated by horizontal arrows to and from the left. The operations of the firing console 11 are shown with boxes and vertical arrows in the center column. The firing console 11 communicates with the integrated delay detonators 15A, 15B, . . . 15N as indicated by horizontal arrows to and from the right.

Figure 10:
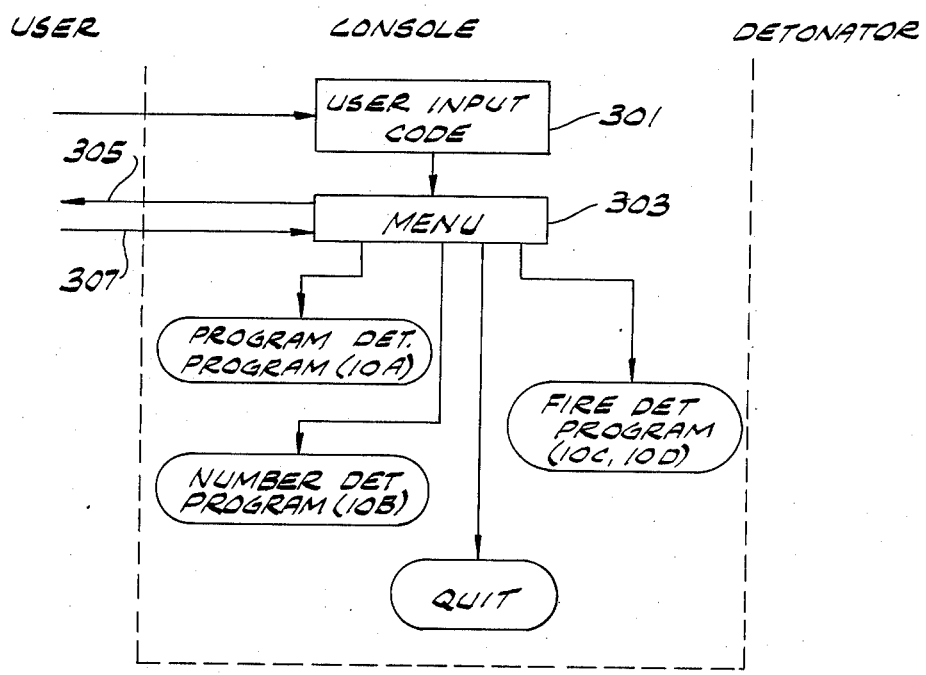
FIG. 10 is a flowchart of operations performed by firing console 11 of FIG. 1.

In FIG. 10, the computer asks user to key in an authorized user code at step 301. If user responds satisfactorily, menu choices are presented at step 303 by indicating the menu to user (arrow 305). User inputs a menu choice (arrow 307). User selects program of FIG. 10A, FIG. 10B, FIG. 10C and 10D, or ends interaction with option "Quit."

Figure 10A:
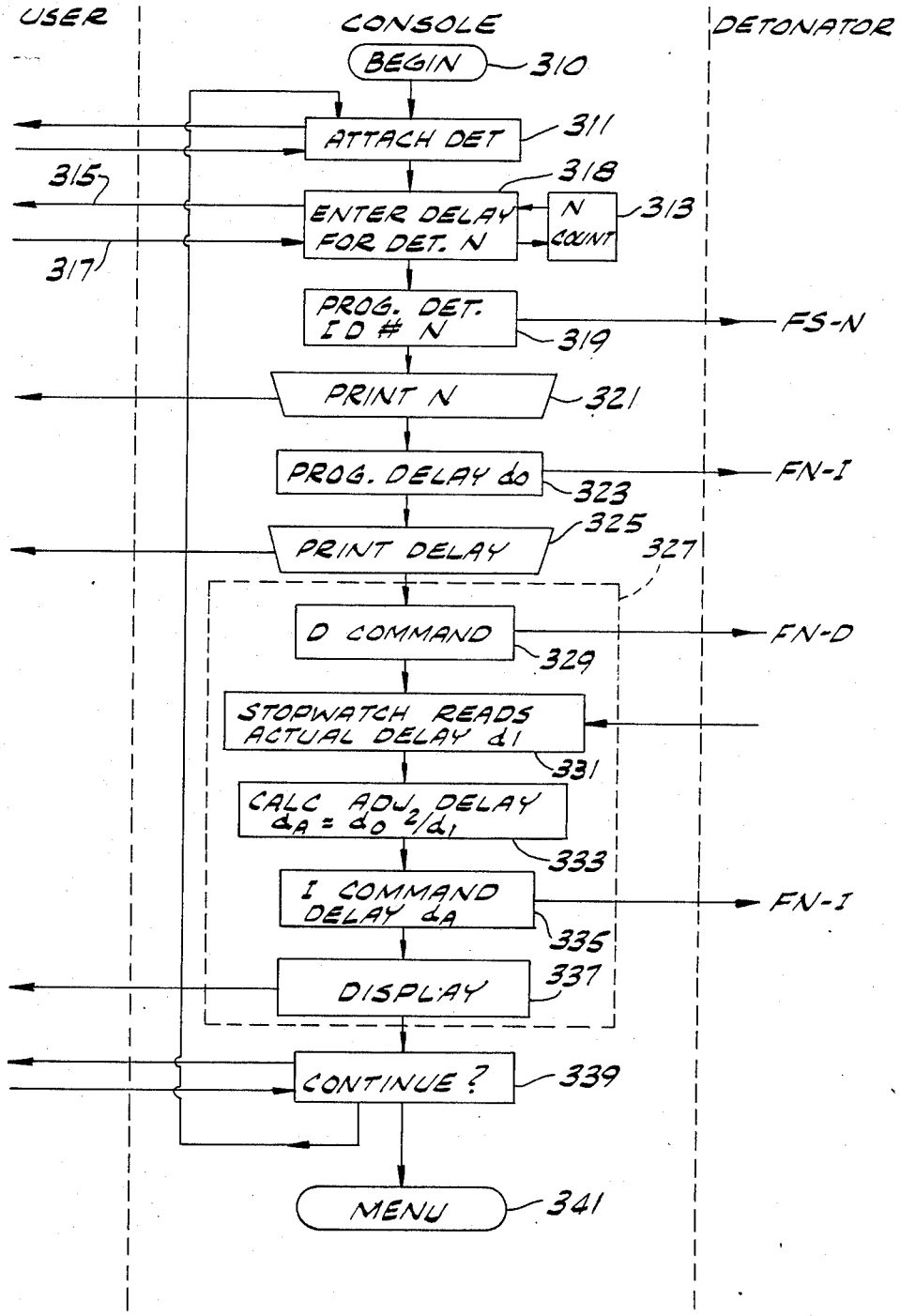
FIG. 10A is a flowchart of a menu option for programming a delay detonator in the field.

In FIG. 10A, user is able to program electrical delay detonators according to the present invention so as to give them unit identifying codes and delay modulus values. Operations proceed from BEGIN 310. User attaches or electrically connects as by switching means just one detonator at a time to the firing console at step 311. Computer automatically starts at a number such as "1" at counting routine 313, displays the number assigned (arrow 315). User inputs the desired delay at step 318 by typing in numerals (arrow 317). At step 319, computer programs the detonator by issuing factory code followed by blanks (or some predetermined default value) for the unit identification code to be stored followed by "S" to signify the Store Command followed by the unit identification code (hereinafter designated N) to be programmed into the detonator, e.g. 00000001. At step 321 printing to an optional detonator tag occurs, so as to affix the unit identification serial number 00000001 to the tag. At step 323 computer sends an input command I to the detonator in the following manner. First, the factory code is sent followed by the just programmed unit identification code N. Next the letter "I" is sent. Next the ten digit delay modulus value is sent. This is indicated on FIG. 10A by the sequence FN-I which is followed by the modulus.

At step 325, computer prints on the optional tag the delay which was just programmmed into the the detonator. The delay programmed into the detonator is next checked in a sequence of steps collectively designated 327. First the computer interrogates the detonator with the delay command D at step 329. The detonator responds, and the computer determines how long the detonator integrated delay circuit downcounter actually takes to count down to zero, by means of a stopwatch routine at step 331. Let the computer programmed delay produced by step 323 be designated $d_o$. Assume that the stopwatch routine at step 331 measures an actual delay $d_1$ observed from the detonator downcounter. Then the firing console performs a compensation by calculating an adjusted delay modulus $d_A=(-d_o^{2)/d_1}$ at step 333. Next the adjusted delay modulus $d_A$ is sent to the detonator by means of the security code FS followed by the I Input Command, followed by the recalculated modulus $d_A$ at step 335. The checking routine is completed at step 337 by displaying the recalculated modulus.

After completion of detonator delay check routine 327, the computer asks user whether it is desired to continue. If so, detonator 1 is disconnected, and a second detonator is attached at step 311, and counting routine 313 assigns the numeral "2" to the next detonator. If it is not desired to continue, the routine of FIG. 10A is completed and the program returns to the menu at step 341.

Figure 10B:
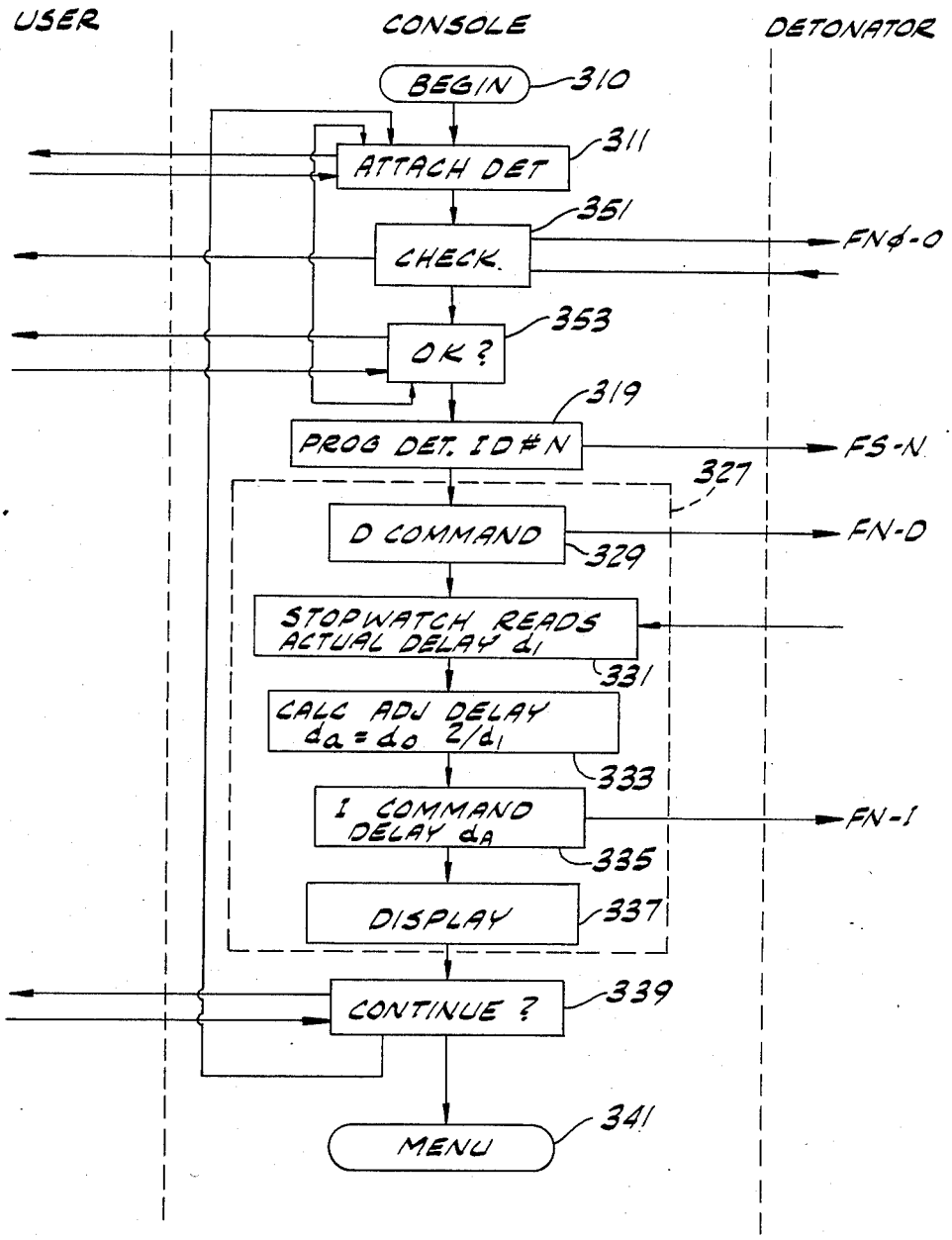
FIG. 10B is a flowchart of a menu option for programming a selected Unit Identification Code into a delay detonator which has been previously delay-programmed at a factory.

FIG. 10B shows a menu option for numbering detonators of the invention having factory preprogrammed delays. Corresponding steps are given identical numbers in FIG. 10B as those in FIG. 10A, and further description of the corresponding steps 310, 311, 327, 339, and 341 of FIG. 10B is omitted for conciseness. It is presumed that the user has obtained a set of detonators which have respective delays factory preprogrammed into them. User checks the detonator at step 351 which has been attached at step 311. The computer interrogates the detonator by sending the secret factory security code F, followed by a default value such as all zeros or all ones which has been stored in the detonator during manufacture, followed by the output command "0". The detonator responds to the interrogation by transmitting back its delay modulus which is displayed on the user's computer CRT screen. At step 352 computer asks user if the delay displayed is ok. If user responds that the delay is not ok, either because a detonator of unintended delay was selected by user inadvertently or because of manufacturing error, then the routine tells user to attach another detonator returning to step 311. If the delay displayed is ok at step 353, then operations proceed to check the actual delay by means the sequence of check steps designated 327.

Figure 10C:
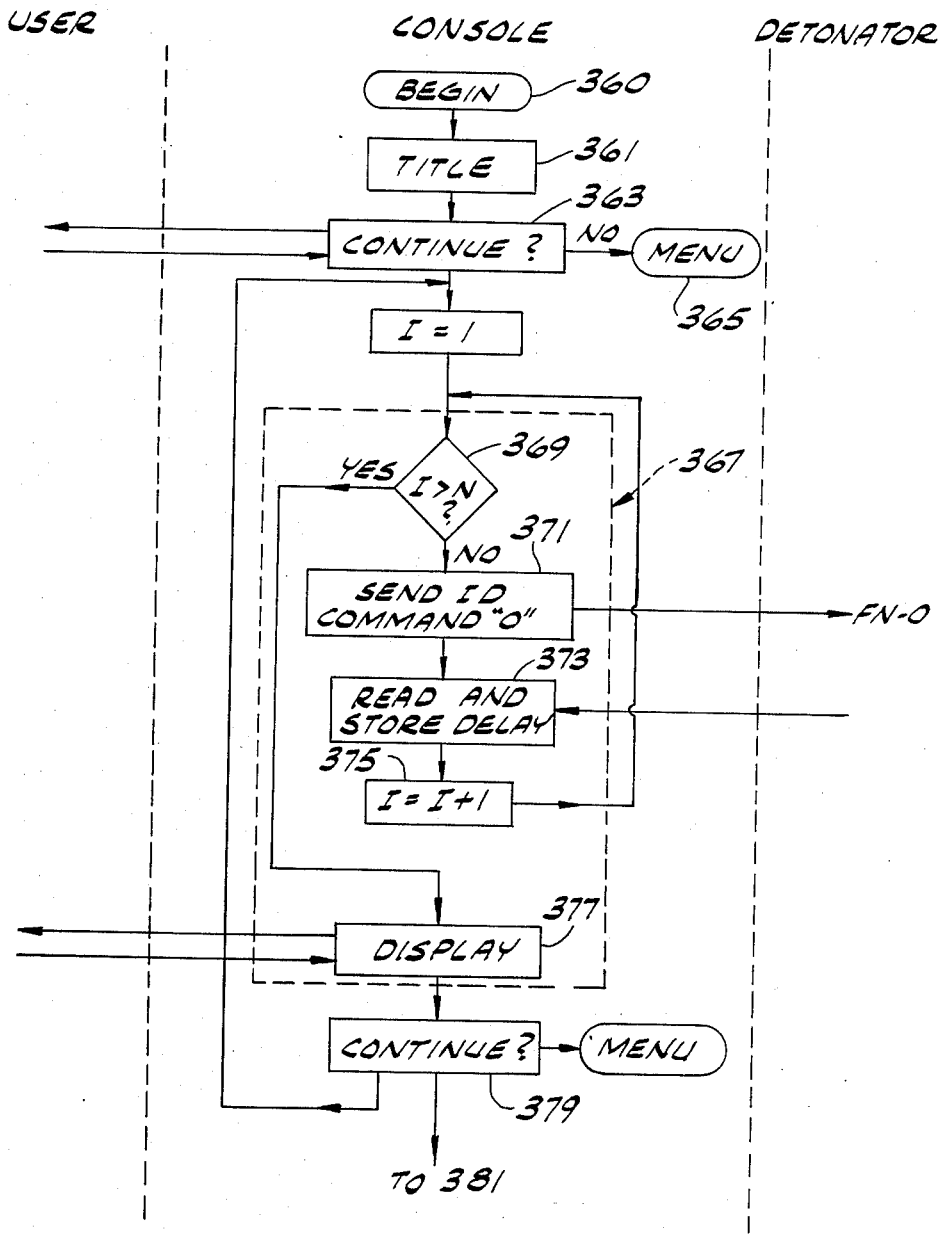
FIGS. 10C and 10D are two halves of a flowchart for firing the delay detonators of FIG. 1.
Figure 10D:
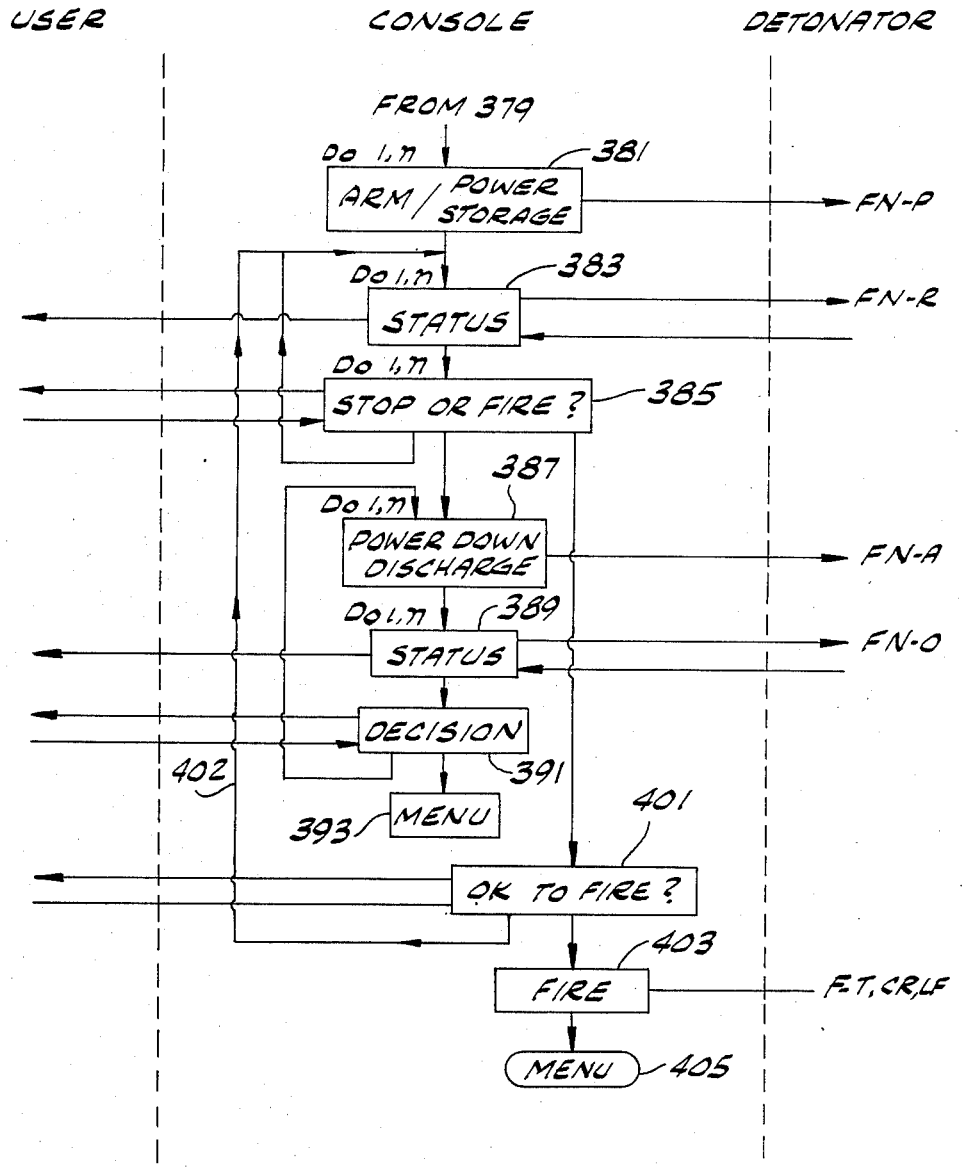

Firing a plurality of detonators connected as shown in FIG. 1 is accomplished by the routine of FIGS. 10C and 10D. Operations begin at BEGIN 360. Computer displays a title of the routine such as "***FIRING PROCEDURE***", at step 361. At step 363, user is asked whether it is desired to continue. If not, operations return to the Menu at step 365. If it is desired to continue, the computer executes a loop 367 of checking detonators out for a final time automatically, as to determine that all detonators are connected and communicating. This loop 367 comprises steps of checking the index I at step 367, sending the security code portions FN followed by output command "0" to each of the detonators in turn by incrementing the unit identification code in the security code sent, a number of times equal to the total number of detonators so as to address each detonator. The delay modulus information is received back and stored in memory. A count of the moduli sent back or other computations are performed so as to digest the data being obtained to a manageable form. At step 377 user receives a display of the number of detonators which have responded. At step 379**, user is asked whether operations should continue. If user expects that there should be 25 detonators in their locations, and only 24 have responded, then operations are terminated and return to menu. If user desires to perform the check again, operations are returned to the check routine by return arrow.

If all detonators are communicating, user is ready to arm the detonator array. In FIG. 10D, the command Power Up "P" is given to all the detonators in sequence to arm the detonators at step 381. When integrated delay circuits of such type as can return an arming status are utilized (such as in microprocessor version of FIG. 9 of the invention), a final status check is automatically made by issuing Ready Status R commands sequencing at electronic speed through all n of the detonators and receiving back a confirmation character "Y" that all are armed, in that all Power Ready PR-bar outputs of the voltage regulators in the delay integrated circuits are brought low. See step 383. The results of the status check are communicated to the user and user is asked at step 385 whether to stop or to fire.

If the decision is made to stop, then at step 387 user causes the Abort Command "A" to be issued to each detonator in sequence in the detonator array. A status check (Ready Status command R) is again made when using microprocessor detonators of FIG. 9 by addressing all of the detonators in sequence at step 389, this time to determine that all of the detonators have been powered down as indicated by confirmation character "N" reflecting that all PR-bar outputs of their voltage regulators have been brought back high. When this has been accomplished at steps 389 and 391, the menu is again reached at step 393.

When the decision is made to fire, then at step 401 the computer asks user one final time whether the decision is settled to fire the detonator array. If not, loop 402 is made back to status check 383. If so, the fire command "T" is issued at step 403 preceded by the factory security code portion to the whole detonator array and the detonators are exploded. Operations end by returning to menu at step 405.

Figure 11:
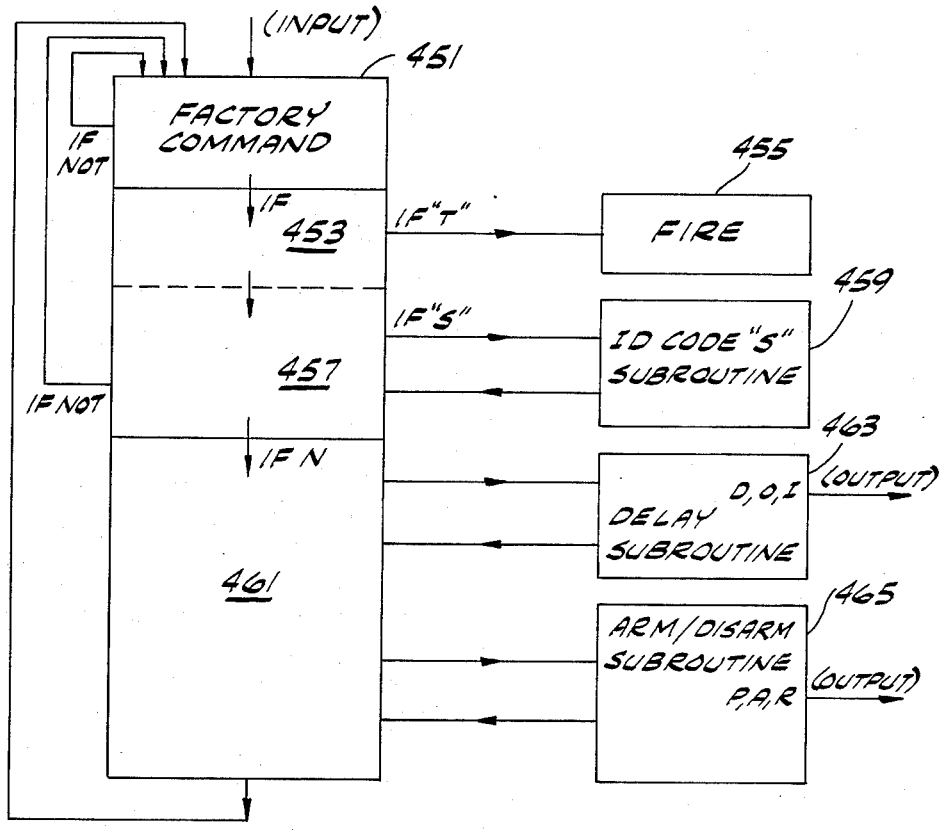
FIG. 11 is a flowchart of operations performed by the microcomputer integrated delay circuit of FIG. 9.

In FIG. 11 a flowchart of the operations of the microcomputer circuit in each integrated delay circuit of FIG. 9 is shown. The firing console sends the Factory Code followed by a Unit Identification Code followed by a letter signifying a command followed by any numerals as appropriate to the command. In step 451 CPU 205 looks for a match with the predetermined factory code portion of the security code stored in ROM 209 by monitoring the string of characters arriving at serial interface 207. When the factory code is found, the software drops down to a succession of decision branches, or IF statements. If the Fire Command "T" is received followed by characters such as carriage return and line feed, then the Fire routine 455 is accessed. If the Fire Command is not received, then operations proceed to step 457. In step 457 the software transfers operations to subroutine 459, for accomplishing operations involving the Unit Identification Code. Routine 459 looks up in EEPROM 211 for a Unit Identification Code. If only a default value is found therein, then if the Unit Identification Code portion sent from the firing console matches the default value, then operations proceed to the routine 461. If the Unit Identification Code portion sent from the firing console does not match the default value, then the routine 459 looks for the Store Command letter "S". If the S is received, then the default value will be replaced by the Unit Identification Code portion sent from the firing console as the new Unit Identification Code of the individual detonator itself in the EEPROM 211. If the S is not received, then the routine assumes that whatever command is coming is intended for some other detonator and operations are transferred back to step 451.

Now assume that there is a Unit Identification Code stored in EEPROM 211 which is not a default value but instead is a previously stored code identifying the detonator as a unit. If the code sent from the factory console 11 does not match the previously stored code, operations also branch back to step 451. If the code sent from the factory console 11 does match the previously stored code, operations proceed to the routine 461.

In output routine 461 the software analyzes the string for the command letters I (Input), D (Delay), O (Output), A (Abort), P (Arm/Power Up), and R (Ready Status). If one of these letters is not found, operations branch back to step 451. If one of these letters is found, then if the letter is either D, O, or I, then operations branch to routine 463, and if the letter is either P or A then operations branch to routine 465.

In routine 463, if the command is "O", the routine accesses EEPROM 211 and obtains the number stored therein for the delay time interval, then immediately transmits the number in serial form from serial I/O interface 207 back to firing console 11. If the command is "D", the routine 463 accesses EEPROM 211 and obtains the number stored therein for the delay time interval, outputs a start pulse or character to notify firing console 11 that a stopwatch interval is commencing, sets a timer running based on the number obtained so that the timer runs for an actual time interval related to or equal to the delay time interval represented by the number stored in the EEPROM for the delay, and when the timer has completed running then transmits the number representing delay in serial form from serial I/O interface 207 back to firing console 11.

In routine 463, if the command is "I", the routine reads in the next 10 ASCII characters indicative of the delay time interval desired by firing console 11 and stores them in the EEPROM 211 as the number stored therein for the delay time interval. This number is defaulted to zero in manufacture until an I command is used to enter a nonzero delay in EEPROM 211 either at the factory or in the field.

In routine 465, if the arming command P is received, the routine cancels any previously set Power Down (PD-bar) signal and outputs a Power Up (PU-bar) signal from programmable I/O 215 of FIG. 9, to voltage regulator 75 to charge the capacitor 63. If the abort command A is received, the routine 465 cancels any previously set Power Up (PU-bar) signal and outputs a Power Down (PD-bar) signal from programmable I/O 215 of FIG. 9, to voltage regulator 75 to discharge the capacitor 63.

If the ready status command R is received, then routine 465 reads in the state of signal Power Ready (PR-bar) from voltage regulator 75 through programmable I/O 215. If signal Power Ready is low, signifying that capacitor 63 is not discharged, then CPU 205 sends firing console 11 the ASCII character "Y" through serial interface 207.. If signal Power Ready is high, then CPU 205 sends the character "N".

At the end of execution of any of the commands in routine 465, control is transferred back to step 451 to permit the software to look for more transmissions from the firing console 11.

The invention is able to be practiced in many embodiments for realizing the full utility of the invention. Among the embodiments are those which accomplish transmissions between the firing console and the detonators by fiber optics or other transmission subsystems.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Electronic apparatus for use with a capacitor, an explosive, a supply of electrical energy, and a firing console for transmitting information including commands and a firing delay time, the apparatus comprising:

means for storing an electrical representation of the firing delay time supplied from the firing console, for transmitting the stored firing delay time representation to the firing console in response to a first command supplied from the firing console, for supplying a first signal in response to a second command from the firing console, and for supplying a second signal as soon as a time interval, commencing on a third command from the firing console, has elapsed, which time interval is substantially equal to the stored firing delay time; and means for charging the capacitor from the supply in response to occurrence of the first signal and for transferring electrical energy from the capacitor so charged to the explosive thereby to fire the explosive in response to occurrence of the second signal.

2. Electronic apparatus as set forth in claim 1 wherein the storing and transmitting means comprises means for also terminating the first signal in response to a fourth command from the firing console prior to the second signal being supplied and causing stored electrical energy in the charging and transferring means to be dissipated, whereby the apparatus is disarmed.

3. Electronic apparatus as set forth in claim 1 wherein said storing and transmitting means comprises microcomputer means having a processor means, memory means, serial interface means for communicating with the firing console, and interface means for communicating the first and second signals to the charging and transferring means.

4. Electronic apparatus as set forth in claim 1 wherein said storing and transmitting means comprises:

serial interface means for communicating with the firing console;

means for decoding the commands;

down counter means; and logic circuit means responsive to the means for decoding the commands for enabling the delay storing means, the serial interface means, and the down counter means and for supplying the first and second signals.

5. Electronic apparatus as set forth in claim 1 wherein said storing and transmitting means includes means operable prior to the second signal being supplied for also storing a code identifying the apparatus as a unit, for comparing information transmitted from the firing console with the unit identifying code, and for responding to the first command from the firing console only when the first command from the firing console is accompanied by information which matches the stored unit identifying code.

6. Electronic apparatus as claimed in claim 1 wherein said storing and transmitting means comprises means for also responding to a fourth command from the firing console so as to ascertain the actual time which will elapse if the third command were to be given.

7. Electronic apparatus as set forth in claim 2 wherein said terminating and causing means comprises first switching means responsive to the termination of the first signal for disconnecting the capacitor from the supply and second switching means responsive to the termination of the first signal for subsequently shorting the capacitor.

8. Electronic apparatus as set forth in claim 1 wherein the storing and transmitting means includes means operable prior to the second signal being supplied for also decoding the transmitted information from the firing console into a security portion and into a command portion and for preventing the second signal unless the security portion matches a predetermined code.

9. Electronic apparatus as set forth in claim 1 wherein said charging and transferring means comprises electrical leads to the explosive and switching means for shorting the electrical leads except upon the occurrence of the second signal.

10. Electronic apparatus as set forth in claim 9 wherein said charging and transferring means further comprises second switching means for shorting the capacitor until the occurrence of the first signal and third switching means responsive to the second signal for connecting the charged capacitor to the electrical leads.

11. Electronic apparatus as set forth in claim 10 wherein said charging and transferring means further comprises two conductors across which said second switching means is connected and said third switching means includes two field effect transistors having respective gates connected together and supplied with the second signal and wherein said field effect transistors are connected in series with the two conductors respectively to said first-named switching means.

12. Electronic apparatus as set forth in claim 1 wherein said charging and transferring means comprises switching means for shorting the capacitor until the occurrence of the first signal.

13. Electronic apparatus as set forth in claim 1 wherein said charging and transferring means includes means for producing a not-ready signal until the capacitor is charged, and said storing and responding means comprises means responsive to the not-ready signal for preventing the second signal until the capacitor is charged.

14. Electronic apparatus as set forth in claim 13 wherein said charging and transferring means further comprises switching means responsive to the first signal for admitting the electrical energy from the supply to the capacitor.

15. Electronic apparatus as set forth in claim 14 wherein said charging and transferring means further comprises a diode bridge rectifier having input leads for connection to the supply and output lines connected by said switching means to the capacitor.

16. Electronic apparatus as set forth in claim 15 wherein said switching means further comprises two field effect transistors having respective gates connected together and supplied with the first signal and wherein said field effect transistors are connected in series with the bridge rectifier output lines respectively.

17. Electronic apparatus as set forth in claim 1 wherein said charging and transferring means includes first switching means for shorting the capacitor until the occurrence of the first signal, second switching means having two conductors for admitting the electrical energy from the supply and responsive to the first signal for connecting each conductor to the capacitor, and means for producing a not-ready signal until the capacitor is charged, said storing and responding means comprising means responsive to the not-ready signal for preventing the second signal until the capacitor is charged, and said charging and transferring means further includes electrical leads to the explosive, third switching means for shorting the electrical leads except upon the occurrence of the second signal and fourth switching means responsive to the second signal for connecting the electrical leads to the charged capacitor. pg,54

18. Electronic apparatus as set forth in claim 1 wherein said storing and transmitting means comprises means operable prior to the second signal being supplied for also storing a code identifying the apparatus as a unit, for comparing information transmitted from the firing console with the unit identifying code and for supplying the first signal in response to the second command from the firing console only when the second command from the firing console is accompanied by information which matches the stored unit identifying code.

19. An electronic delay detonator for use with a supply of electrical energy and a firing console for providing commands and a firing delay time, the electronic delay detonator comprising:

a capacitor;

an explosive; and electronic apparatus including:

means for storing an electrical representation of the firing delay time supplied from the firing console, for transmitting the stored firing delay time representation to the firing console in response to a first command supplied from the firing console, for supplying a first signal in response to a second command from the firing console, and for supplying a second signal as soon as a time interval, commencing on a third command from the firing console, has elapsed, which time interval is substantially equal to the stored firing delay time; and means for charging the capacitor from the supply in response to occurrence of the first signal and for transferring electrical energy from the capacitor so charged to the explosive thereby to fire the explosive in response to occurrence of the second signal.

20. An electronic delay detonator as set forth in claim 19 wherein said storing and transmitting means comprises means for also transmitting to the firing console a signal indicating whether the capacitor is charged.

21. An electronic delay detonator as set forth in claim 19 wherein said storing and transmitting means comprises a complementary metal oxide semiconductor circuit capable of operating under power from the capacitor during the time interval after the third command from the firing console.

22. An electronic delay detonator as set forth in claim 19 wherein the apparatus further comprises a pair of conductors and means for coupling both the charging and transferring means and the storing and transmitting means to the pair of conductors whereby the apparatus is externally connectable to the supply and to the firing console by the pair of conductors.

23. An electronic delay detonator as set forth in claim 19 wherein the charging and transferring means includes means for igniting the explosive upon receiving electrical energy from the capaitor; and means responsive to the second signal for coupling said capacitor to the igniting means whereby the detonator is fired when the second signal occurs.

24. An electronic delay detonator as claimed in claim 19 wherein the detonator further comprises means for isolating the detonator from high voltages and transients, whereby protection from electrical interference is obtained.

25. A detonation system for use with a supply of electrical energy comprising:

user operable firing console means for selectably transmitting unit identification information, firing delay time information and selections from a command set including at least first, second and third commands, and for displaying responses to at least one of the commands; and a plurality of units of apparatus each comprising in physical association:

an explosure;

means for storing a code identifying the apparatus as a unit, for storing an electrical representation of the firing delay time information supplied from the firing console, for transmitting the stored firing delay time representation to the firing console in response to the first command supplied from the firing console only when the firing console has previously sent unit identification information matching the stored code, for supplying a first signal in response to the second command from the firing console, and for supplying a second signal as soon as a time interval, commencing on the third command from the console, has elapsed, which time interval is substantially equal to the stored firing delay time; and means for temporarily storing electrical energy from the supply in response to occurrence of the first signal and for transferring stored electrical energy to the explosive thereby the fire the explosive in response to occurrence of the second signal.

26.

A detonation system as set forth in claim 25 wherein each unit of apparatus further comprises a pair of conductors connected in parallel to each said pair of conductors in all of the other said units and connected to the firing console, and means for coupling both the charging and transferring means and the storing and transmitting means in each unit to the pair of conductors.

27. A detonation system as set forth in claim 25 wherein each storing and transmitting means comprises means for also terminating the first signal in response to a fourth command from the firing console prior to the second signal being supplied and thereby causing any electrical energy in each said energy storing and transferring means to be dissipated so that the units of apparatus are disarmed.

28. A detonation system as set forth in claim 25 wherein each said storing and transmitting means comprises means for also transmitting to the firing console a signal indicating whether any electrical energy is stored in the energy storing and transferring means.

29. A detonation system as set forth in claim 25 wherein each said storing and transmitting means comprises a complementary metal oxide semiconductor circuit capable of operating under power from the energy storing and transferring means during the time interval commencing on the third command from the firing console.

30. A detonation system as set forth in claim 25 wherein each said storing and transmitting means comprises:

serial interface means for communicating with the firing console;

means for decoding the commands;

down counter means; and logic circuit means responsive to the means for decoding the commands for enabling the delay storing means, the serial interface means, and the down counter means and for supplying the first and second signals.

31. A detonation system as set forth in claim 25 wherein each said storing and transmitting means comprises microcomputer means having a processor means, memory means, serial interface means for communicating with the firing console, and interface means for communicating the first and second signals to the charging and transferring means.

32. A detonation system as set forth in claim 25 wherein said firing console means includes means operable prior to the second signal being supplied for storing a code including a prestored normally user-inaccessible code portion and means for transmitting to the units one or more of the selections from the command set with the user-inaccessible code portion and the unit identification information.

33. A detonation system as set forth in claim 32 wherein said means for storing and transmitting also comprises means for decoding the user-inaccessible code portion from said firing console means and for supplying the second signal in response to the third command only if the user-inaccessible code portion matches a predetermined code.

34. An electronic circuit for use in an electrical delay detonation system including a firing console for sending information transmissions and a detonator with means for firing the detonator in response to occurrence of a signal to fire, the electronic circuit comprising:

means for decoding the transmissions from the firing console into a security portion and into a command portion; and means for generating the signal to fire in response to one of the transmissions from the firing console only if the security portion of said one transmission matches a predetermined code.

35. An electronic circuit as set forth in claim 34 wherein the generating means comprises means for also storing a firing delay time representation and transmitting the stored firing delay time representation to the firing console.

36. An electronic circuit as set forth in claim 35 wherein the transmitting of the stored firing delay time representation is delayed subsequent to the decoding of the command portion by a predetermined time interval related to the firing delay time, whereby error in the electronic circuit is made detectable by the firing console.

37. A firing console for operation in combination with a plurality of delay detonators, the firing console comprising:

means for storing a code including a prestored normally user-inaccessible code portion; and means for transmitting a selectable command together with the code to the delay detonators, the code as transmitted including the user-inaccessible code portion and a userselectable code portion indicative of an individual one of the electrical delay detonators for which the selectable command is intended.

38. A firing console as set forth in claim 37 which further comprises means for temporarily storing responses from individual ones of the electrical delay detonators to the selectable command.

39. A firing console as set forth in claim 37 which further comprises means for displaying responses from individual ones of the electrical delay detonators to the selectable command.

40. A firing console as set forth in claim 37 wherein the selectable command is a command for a detonator to respond with a time delay stored in the detonator.

41. A firing console as set forth in claim 37 wherein the selectable command is a command for a detonator to respond with at least one pulse, and the firing console further comprises means for measuring a time interval between the end of the command and the at least one pulse, thereby to ascertain the actual delay of the detonator.

42. A firing console as set forth in claim 37 wherein the selectable command is a command for arming at least one of the detonators.

43. A firing console as set forth in claim 37 wherein the selectable command is a command for aborting arming at least one of the detonators.

44. A firing console as set forth in claim 37 wherein the selectable command is a command for storing time delay information in at least one of the detonators.

45. A firing console as set forth in claim 37 wherein the selectable command is a command for firing at least one of the detonators.

46. A firing console as set forth in claim 37 wherein the selectable command is a command for storing the user- selectable code portion in one of the delay detonators.

* * * * *

UNITED STATES PATENT AND TRADEMARK OFFICE

CERTIFICATE OF CORRECTION

PATENT NO. : 4,674,047

DATED : June 16, 1987

INVENTOR(S) : Lawson J. Tyler and Paul N. Worsey

It is certified that error appears in the above—identified patent and that said Letters Patent is hereby corrected as shown below:

Column 24, after claim 17, line 31, --pg,54-- should be deleted. Column 25, claim 25, line 39, "explosure" should read --explosive--. Column 25, claim 25, line 52, "the console" should read --the firing console--. Column 25, claim 25, line 58, "the fire" should read --to fire--. Column 25, claim 26 line 60, the claim numeral "26." should be directly followed by its claim words shown on subsequent lines.

Signed and Sealed this

Sixteenth Day of August, 1988

*Attest:*

DONALD J. QUIGG

*Attesting Officer*

*Commissioner of Patents and Trademarks*